US009988131B2

(12) United States Patent
Lee et al.

(10) Patent No.: US 9,988,131 B2
(45) Date of Patent: Jun. 5, 2018

(54) CANISTER TYPE THRUSTER AND INSTALLATION METHOD THEREOF

(71) Applicant: SAMSUNG HEAVY IND. CO., LTD., Seoul (KR)

(72) Inventors: Deok-Hoon Lee, Gyeongsangnam-do (KR); Myung-Sung Kim, Gyeongsangnam-do (KR); Young-Deok Park, Gyeongsangnam-do (KR); Jeung-Hoon Baek, Gyeongsangnam-do (KR); In-Ho Yang, Gyeongsangnam-do (KR); Bong-Rea Yun, Gyeongsangnam-do (KR); Tae-Min Cho, Gyeongsangnam-do (KR); Sung-Tae Choi, Gyeongsangnam-do (KR); Hee-Young Heo, Gyeongsangnam-do (KR)

(73) Assignee: SAMSUNG HEAVY IND. CO., LTD., Seoul (KR)

( * ) Notice: Subject to any disclaimer, the term of this patent is extended or adjusted under 35 U.S.C. 154(b) by 0 days. days.

(21) Appl. No.: 15/456,474

(22) Filed: Mar. 10, 2017

(65) Prior Publication Data

US 2017/0233048 A1 Aug. 17, 2017

Related U.S. Application Data

(62) Division of application No. 14/779,963, filed as application No. PCT/KR2014/002687 on Mar. 28, 2014, now Pat. No. 9,834,289.

(30) Foreign Application Priority Data

Mar. 29, 2013 (KR) ..... 10-2013-0034367
May 10, 2013 (KR) ..... 10-2013-0053416
(Continued)

(51) Int. Cl.
*F16M 1/00* (2006.01)
*B63H 5/125* (2006.01)
*B63H 25/42* (2006.01)

(52) U.S. Cl.
CPC ..... *B63H 5/125* (2013.01); *B63H 25/42* (2013.01); *B63H 2005/1256* (2013.01); *B63H 2025/425* (2013.01)

(58) Field of Classification Search
CPC ..... E02B 17/06; F16D 1/096; B63H 5/125; B63H 25/42
See application file for complete search history.

(56) References Cited

U.S. PATENT DOCUMENTS 3,529,104 A * 9/1970 Angle ..... H01H 19/186 200/47
4,453,858 A * 6/1984 Guiader ..... E02B 17/06 254/95
(Continued)

FOREIGN PATENT DOCUMENTS

JP 2001-97284 4/2001
JP 2001-151191 6/2001
(Continued)

OTHER PUBLICATIONS

Office Action dated Mar. 27, 2017 for the U.S. Appl. No. 14/779,963 (now published as U.S. Patent Publication No. 2016/0083061).
(Continued)

*Primary Examiner* — Amy J. Sterling
(74) *Attorney, Agent, or Firm* — Ladas & Parry, LLP

(57) ABSTRACT

Disclosed are a canister type thruster for implementing smooth upward/downward movement and improving productivity and an installation method thereof. The canister type thruster includes a guide module for guiding upward/downward movement of a canister. The guide module includes: a guide unit that is installed on an inner surface of
(Continued)

a trunk so as to support a rack installed on an outer surface of the canister in parallel with a lifting direction to guide the upward/downward movement of the canister, a sliding pad that relieves an impact or a friction applied to the guide unit; and a support protrusion that is provided between the guide unit and the sliding pad to support the sliding pad.

7 Claims, 36 Drawing Sheets

(30) Foreign Application Priority Data

May 16, 2013 (KR) ..... 10-2013-0055512
May 16, 2013 (KR) ..... 10-2013-0055657
May 23, 2013 (KR) ..... 10-2013-0058076

(56) References Cited

U.S. PATENT DOCUMENTS

| | | | | |
|---|---|---|---|---|
| 4,512,553 | A | 4/1985 | Dunham et al. | |
| 5,139,366 | A | 8/1992 | Choate et al. | |
| 5,486,069 | A | 1/1996 | Breeden | |
| 6,293,734 | B1 | 9/2001 | Thomas et al. | |
| 6,663,313 | B2 * | 12/2003 | Lewis | F16D 1/096 403/369 |
| 2016/0083061 | A1 | 3/2016 | Lee et al. | |

FOREIGN PATENT DOCUMENTS

| | | |
|---|---|---|
| KR | 10-2007-0106090 | 11/2007 |
| KR | 10-2010-0003161 | 1/2010 |
| KR | 10-2010-0074397 | 7/2010 |
| KR | 10-2011-0139545 | 12/2011 |
| KR | 10-2012-0093217 | 8/2012 |
| WO | 2012/132400 | 10/2012 |

OTHER PUBLICATIONS

ISR for PCT/KR2014/002687 dated Jul. 25, 2014 and its English translation by WIPO.
Written Opinion for PCT/KR2014/002687 dated Jul. 25, 2014 and its English translation by Google Translate/OCR by Abode Acrobat Pro.
IPRP Chapter 2 for PCT/KR2014/002687 dated Jul. 12, 2014 and its English by WIPO.
*Ex Parte Quayle* Action dated Jan. 12, 2017 for U.S. Appl. No. 14/779,963 (now published as U.S. Patent Publ. 2016/0083061).
Non-Final Office Action dated Aug. 17, 2016 for U.S. Appl. No. 14/779,963 (now published as U.S. Patent Publ. 2016/0083061).
Supplementary European Search Report dated Oct. 4, 2016 for European Patent Application No. 14774506.1.
Office Action dated Jul. 4, 2017 for Chinese Patent Application No. 201480018321.2 and its English translation by Global Dossier.
Office Action dated Oct. 17, 2017 for European Patent Application No. 14774506.1.
Notice of Allowance dated Aug. 2, 2017 for U.S. Appl. No. 14/779,963 (now published as US 2016/0083061).
Notice of Allowance dated Dec. 20, 2017 for Chinese Patent Application No. 201480018321.2 and its English translation by Global Dossier.

* cited by examiner

【Fig. 31】
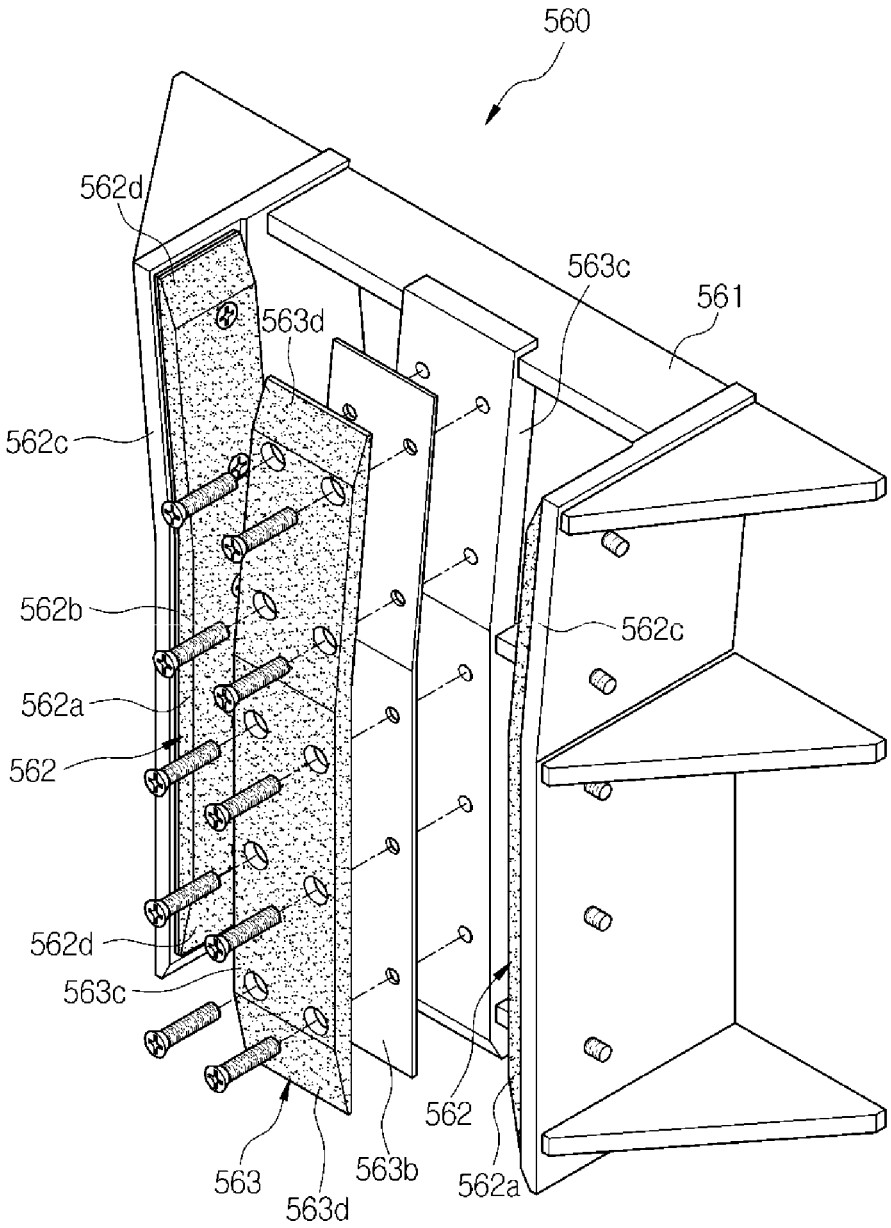

【Fig. 32】
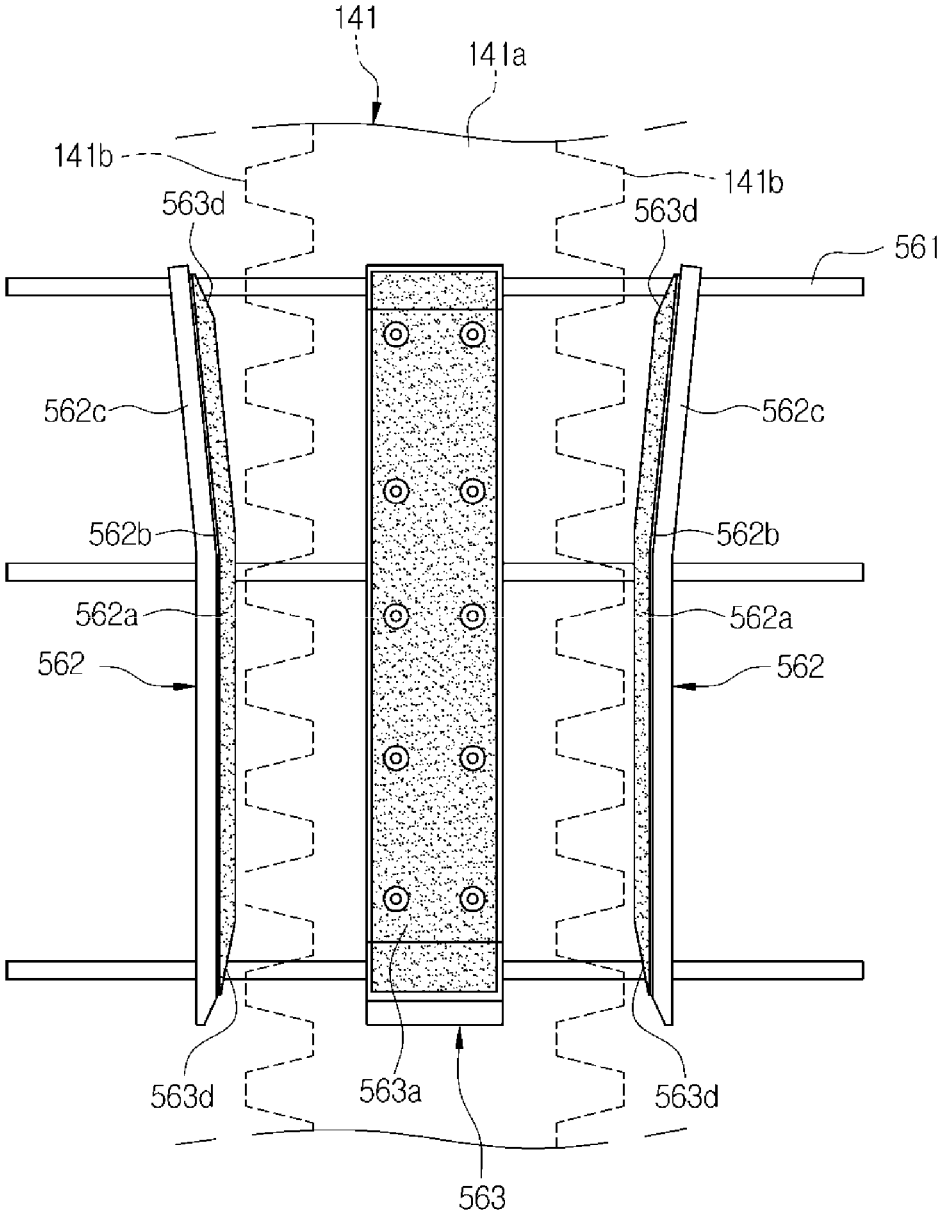

【Fig. 33】
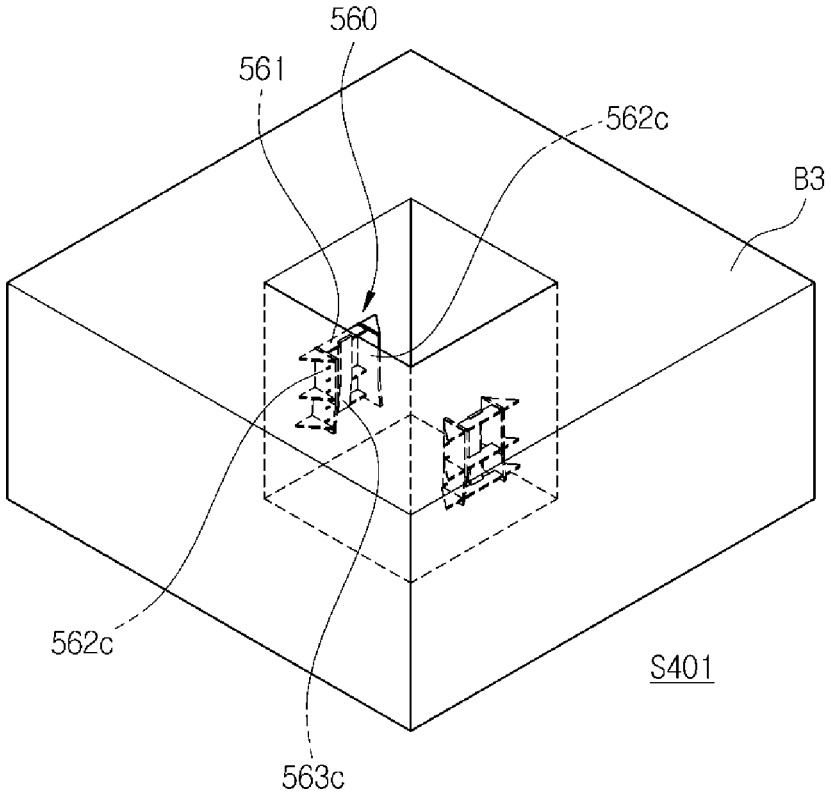

【Fig. 34】
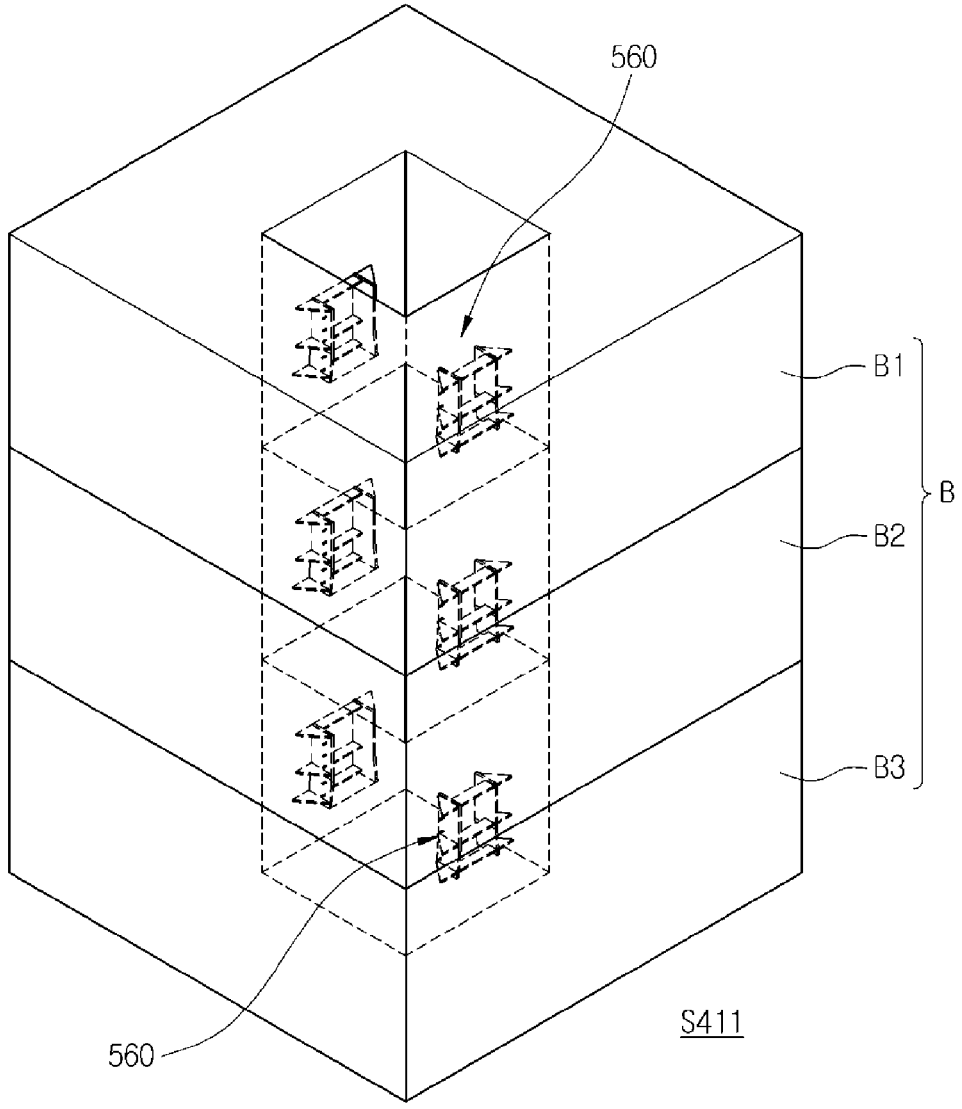

【Fig. 35】
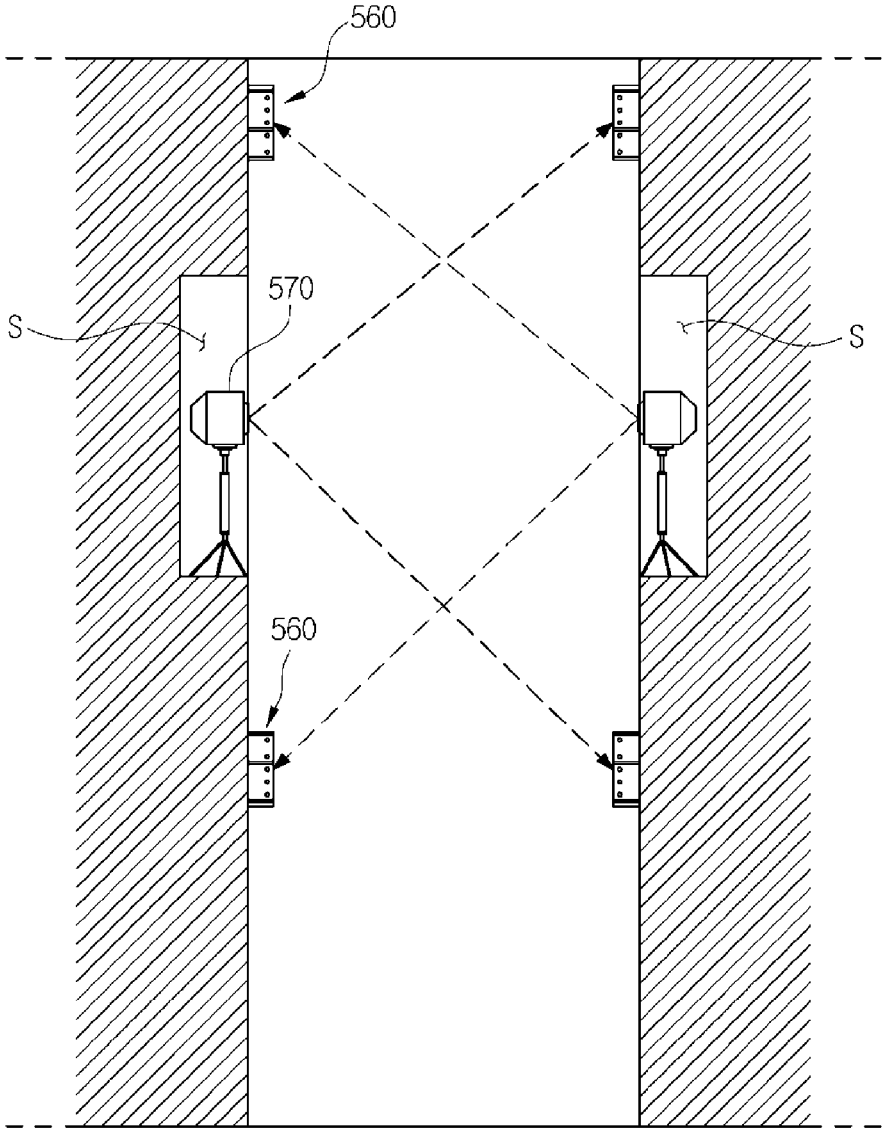
S421

【Fig. 36】
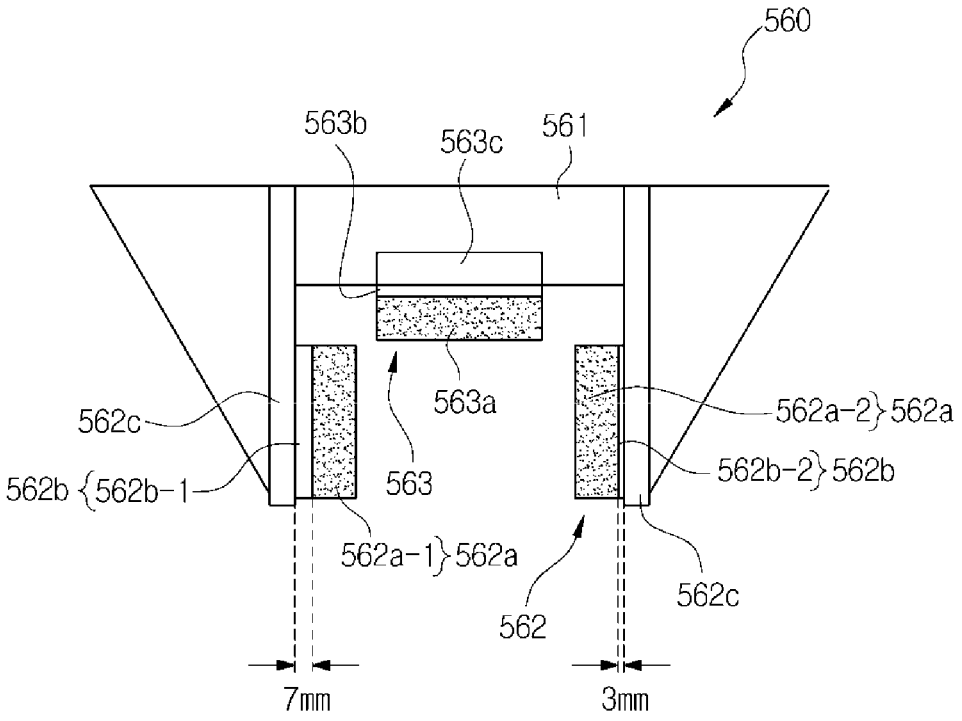
S431

CANISTER TYPE THRUSTER AND INSTALLATION METHOD THEREOF

CROSS-REFERENCE TO RELATED APPLICATIONS

This application is the Divisional Application of the U.S. patent application Ser. No. 14/779,963, filed on Sep. 24, 2015, which is the U.S. National Stage of International Patent Application No. PCT/KR2014/002687 filed on Mar. 28, 2014, which claims the priority to Korean Patent Application No. 10-2013-0034367 filed in the Korean Intellectual Property Office on Mar. 29, 2013, Korean Patent Application No. 10-2013-0053416 filed in the Korean Intellectual Property Office on May 10, 2013, Korean Patent Application No. 10-2013-0055512 filed in the Korean Intellectual Property Office on May 16, 2013, Korean Patent Application No. 10-2013-0055657 filed in the Korean Intellectual Property Office on May 16, 2013, and Korean Patent Application No. 10-2013-0058076 filed in the Korean Intellectual Property Office on May 23, 2013, the entire contents of which are incorporated herein by reference.

TECHNICAL FIELD

The present invention relates to a canister type thruster capable of easily implementing stable upward/downward movement of a canister and improving productivity, and a method of installing the same.

BACKGROUND ART

Special ships such as drillships should be able to be anchored in a marine work area, and thus require dynamic positioning systems capable of maintaining their positions under the influences of tides, winds, and wave heights. Therefore, these ships are equipped with thrusters capable of generating a propulsive force to control positions of hulls thereof during a change of direction under water.

The thrusters are typically installed at lower portions (underwater) of the hulls. Thus, when a breakdown occurs, the thrusters are not easily repaired or replaced. Furthermore, when the thrusters break down on the sea, the hulls should be removed to the shore at which a dock is present for repair according to circumstances. It is a canister type thruster that is proposed to settle this difficult point in view of operation and to allow the thruster to be repaired or replaced in the marine work area. An example of the canister type thruster is disclosed in Korean Unexamined Patent Application Publication No. 10-2010-0003161 (published on Oct. 31, 2012).

Meanwhile, a canister is a giant structure having a sectional width of about 5 to 6 meters and a height of about 10 meters, and is difficult to handle because various devices mounted on the canister are very heavy. Thus, there are many difficulties in raising/lowering the canister in the hull or separating the canister from the hull for maintenance to install it again.

PRIOR ART DOCUMENT

Patent Document: Korean Unexamined Patent Application Publication No. 10-2010-0003161 (published on Oct. 31, 2012)

DISCLOSURE

Technical Problem

Accordingly, the embodiments of the present invention are to provide a canister type thruster capable of smoothly realizing installation and upward/downward movement of a canister and a method of installing the same.

Further, the embodiments of the present invention are to provide a canister type thruster capable of easily performing precision management and a method of installing the same.

Further, the embodiments of the present invention are to provide a canister type thruster capable of stably forming a waterproof structure between a canister and a hull and a method of installing the same.

In addition, the embodiments of the present invention are to provide a canister type thruster that allows a canister to be stably supported in a trunk and a method of installing the same.

Technical Solution

In order to achieve the above object, according to an aspect of the present invention, there is provided a canister type thruster mounted in a trunk of a ship, which includes at least one guide module configured to guide upward/downward movement of a canister. The guide module includes: a lower guide unit that is mounted at a lower portion of the trunk facing a rack installed on an outer surface of the canister in parallel with a lifting direction and guides the rack in a downward direction of the trunk when the canister moves down; an upper guide unit that is mounted at an upper portion of the trunk facing the rack and guides the rack in an upward direction of the trunk when the canister moves up; and a lift unit that is located opposite to the rack between the lower and upper guide units and moves the rack in the upward or downward direction.

Here, each of the lower and upper guide units may include: a guide bracket that is mounted on the trunk; a lateral guide pad that is provided for the guide bracket to be face a lateral portion of the rack; and toothed-part guide pads that are provided for the guide bracket in pair so as to face toothed parts of the rack.

Further, the lift unit may include: a lift guide pad that is located opposite to a lateral portion of the rack; and pinions that are located opposite to toothed parts of the rack and are engaged with the toothed parts of the rack.

The rack may be guided by the lower and upper guide units when the canister moves down, and be guided by the upper and lower guide units when the canister moves up.

Further, a maximum distance (A) between the upper guide unit and the lower guide unit may be at least shorter than a maximum length (B) of the rack.

Here, the canister type thruster may further include an intermediate guide unit that is disposed on the same line between the lift unit and the lower guide unit.

The guide bracket may include: support frames that are fixed to an inner surface of the trunk; a front frame which is mounted on the support frames to face the lateral portion of the rack and to which the lateral guide pad is attached; and lateral frames which vertically protrude from opposite sides of the support frames so as to face the toothed parts of the rack in pair and to which the toothed-part guide pads are attached.

Further, upper and lower portions of the lateral guide pad and the toothed-part guide pads may include tapered surfaces that guide initial entry of the rack.

Further, a leveling pad for adjusting a minute tolerance may be selectively interposed between the lateral guide pad and the front frame or between each of the toothed-part guide pads and each of the lateral frames.

Each of the tapered surfaces may include a first tapered surface that is obliquely formed at an entry which the rack enters, and a second tapered surface that is obliquely formed to extend from the first tapered surface so as to have a smaller gradient than the first tapered surface.

According to another aspect of the present invention, there is provided a canister type thruster mounted in a trunk of a ship, which includes at least one guide module configured to guide upward/downward movement of a canister. The guide module includes: a guide unit that is installed on an inner surface of the trunk to support a rack installed on an outer surface of the canister in parallel with a lifting direction and to guide upward/downward movement of the canister; sliding pads that relieve an impact or a friction applied to the guide unit; and support steps that are provided between the guide unit and the sliding pad to support the sliding pads.

Here, the guide unit may include: a guide bracket that is fixed to the inner surface of the trunk; toothed-part guides that are provided for the guide bracket and come into contact with toothed parts of the rack to guide upward/downward movement of the rack; and a lateral guide that is provided for the guide bracket and comes into contact with a lateral portion of the rack to guide the upward/downward movement of the rack.

Further, the rack may have the toothed parts symmetrically formed at opposite sides thereof in a width direction thereof, and the toothed-part guides may be symmetrically formed at opposite sides of the support bracket so as to guide the toothed parts of the rack.

The sliding pads may be provided at portions at which the toothed-part guides and the lateral guide come into contact with the rack to guide the upward/downward movement of the rack so as to be able to be decoupled and coupled.

The support steps may be provided in the front of each of the toothed-part guides or the lateral guide so as to protrude from each of the toothed-part guides or the lateral guide to support the sliding pad.

The support step may be provided at a front lower end of each of the toothed-part guides or the lateral guide such that a lower end of the sliding pad is caught thereon.

The support step may be formed to be integrated with each of the toothed-part guides or the lateral guide or to be able to be decoupled from or coupled to each of the toothed-part guides or the lateral guide.

The support step may be inserted into a support groove formed in a front surface of each of the toothed-part guide or the lateral guide and a rear surface of the sliding pad to a predetermined depth so as to support the sliding pad.

Further, at least one of the support steps may be provided between each of the toothed-part guide and the sliding pad or between the lateral guide and the sliding pad.

According to still another aspect of the present invention, there is provided a canister type thruster mounted in a trunk of a ship, which includes: a canister configured to move up and down in the trunk; a canister seat provided at a lower end of an inner surface of the trunk and on which the canister is placed; a lift unit configured to move the canister up and down; and a sealing device configured to waterproof a space between the canister and the trunk. The canister seat and the sealing device come into contact with each other.

Here, the canister seat may include a support seat that supports the canister in a vertical direction and a sealing seat that comes into contact with the sealing device.

The sealing seat may be tapered such that a cross section of the trunk is reduced toward a lower side of the trunk.

The sealing device may be provided at a lower end of an outer surface of the canister to come into contact with the sealing seat.

Further, the sealing device may include: a sealing member that is elastically deformable to form a waterproof structure; a fixing bracket that fixedly supports the sealing member on the canister; a sealing limiter that is provided above the fixing bracket to prevent excessive compression of the sealing member; and a support protrusion that is formed to protrude outward from the lower end of the outer surface of the canister so as to support a lower surface of the sealing member.

The sealing limiter may be provided such that a surface thereof facing the sealing seat is tapered in correspondence to the tapered sealing seat.

The fixing bracket may include a coupler that is coupled to the canister and a fixture that fixedly supports the sealing member.

Further, the fixing bracket may be decouplable from and couplable to the canister.

The coupler of the fixing bracket and the outer surface of the canister may be coupled by a bolting method.

The support protrusion may be decouplable from and couplable to the canister.

The canister may include a reinforced plate on an inner surface thereof which corresponds to a position at which the fixing bracket is coupled so as to secure a bearing force for the outer surface thereof.

Further, the canister may include at least one reinforced plate on an inner surface thereof which corresponds to a position at which the sealing limiter is coupled so as to secure a bearing force for the outer surface thereof.

The sealing seat may include at least one reinforced plate on a rear surface thereof which is opposite to a position at which the sealing limiter is provided in a state in which the canister is placed on the support seat of the canister seat so as to secure a bearing force thereof.

According to still another aspect of the present invention, there is provided a canister type thruster mounted in a trunk of a ship, which includes: a canister configured to move up and down in the trunk; a thruster provided at a lower portion of the canister and configured to move up and down along with the canister; and a restrainer configured to restrain the canister in the trunk. The restrainer includes locked rods that horizontally protrude outward from the canister to be locked, and a plurality of locking members that are fixed to an inner surface of the trunk and are provided at position at which the locked rods enter to be locked. The plurality of locking members include a first locking member that has a locking recess into which the locked rod is fitted when the thruster is located below a hull, and a second locking member on which the locked rod rests when the thruster is pulled up into the trunk. The first locking member has an open lower surface and is provided such that an upper surface of the locking recess is inclined downward with the approach to the inner surface of the trunk. The locked rod is provided such that an upper surface of the locked rod is inclined downward with the approach to the inner surface of the trunk in correspondence to a shape of the locking recess, and is fitted into the locking recess of the first locking member.

Here, when the locked rod enters the second locking member, a lower surface of the locked rod may rest on an upper surface of the second locking member.

The upper surface of the second locking member and the lower surface of the locked rod may be horizontally provided flat.

Further, a support rib for securing a bearing force may be provided between an upper surface of the first locking member and the inner surface of the trunk or between a lower surface of the second locking member and the inner surface of the trunk.

The canister type thruster may further include a motor or a hydraulic cylinder for supplying power such that the locked rod protrudes outward from the canister.

The canister type thruster may further include a sealing device that forms a waterproof structure between the canister and a canister seat on which the canister is placed when the thruster is located below a bottom of the hull.

Further, the sealing device may include a sealing member that is elastically deformable to form the waterproof structure, and the sealing member may be formed to protrude from a lower surface of the canister at an inner side of a skirt provided around a lower end of the canister, and is provided between the canister seat and the lower surface of the canister.

When the locked rod enters the locking recess of the first locking member, a degree of compression of the sealing member may be adjustable according to a length by which the locked rod enters.

According to still another aspect of the present invention, there is provided a method of installing a canister type thruster mounted in a trunk of a ship. The method includes: (a) installing guide modules for guiding upward/downward movement of a canister equipped with at least one rack at preset positions of inner surfaces of trunk blocks of a hull or a floating structure which are manufactured in a plurality of block units; (b) assembling the trunk blocks; (c) measuring positions at which the guide modules are installed; and (d) adjusting thicknesses of the guide modules based on an error value between each of the measured installed positions and a preset position to correct the installed position of each of the guide modules.

Here, the racks may be installed at opposite sides of outer surface of the canister in a lifting direction, and are each provided such that toothed parts engaged with pinions are symmetrical. Each of the guide modules may include a support bracket that is fixed to the inner surface of each of the trunk blocks, toothed-part guides that are symmetrically provided at opposite sides of the support bracket so as to guide the opposite toothed parts of the rack, and a lateral guide that comes into contact with a lateral surface of the rack to guide upward/downward movement of the rack. The step (d) may include adjusting thicknesses of the toothed-part guides and the lateral guide based on the error value to correct the installed position of each of the guide modules.

The toothed-part guides and the lateral guide may include entry guides that maintain an inclination with respect to a lifting direction of the rack, and the step (a) may include fixing the support bracket to the inner surface of each of the trunk blocks, and installing the entry guides at a front portion and opposite sides of the support bracket.

Further, the step (d) may include: manufacturing a thickness adjusting plate having a design thickness based on the error value or processing a previously manufactured thickness adjusting plate; installing the thickness adjusting plate in the front of the entry guides; and installing a sliding pad, which comes into contact with the rack to guide the upward/downward movement of the rack, in the front of the thickness adjusting plate.

Further, the step (d) may include: combining previously manufactured thickness adjusting plates having various thicknesses based on the error value to install the combined thickness adjusting plates in the front of the entry guides; and installing sliding pads, which come into contact with the rack to guide the upward/downward movement of the rack, in the front of the thickness adjusting plates.

The support bracket may be fixed by a welding method, and the thickness adjusting plates and sliding pads may be decouplable and couplable by a bolting method.

Further, the step (d) may include: manufacturing a sliding pad having a design thickness based on the error value or processing a previously manufactured sliding pad; and installing the sliding pad in the front of each of the entry guides.

The method may further include: installing a lift drive equipped with the pinions engaged with the rack and a driving source driving the pinions on the inner surface of at least one of the trunk blocks; and correcting an installed position of the lift drive based on an error value between the installed position of the lift drive and a preset position. Two or more of the guide modules may be installed at upper and lower sides of the lift drive.

Further, the step (c) may include applying light to the installed position of each of the guide modules, and extracting information on the position of each of the guide modules based on at least one of a time, distance, and angle of reflected light.

Further, two or more of the guide modules may be installed on the inner surfaces of the trunk blocks such that a spaced distance between an uppermost guide module and a lowermost guide module is shorter than a full length of the rack.

In addition, the guide module may be installed on the same line as the rack.

Advantageous Effects

In the canister type thruster according to an embodiment of the present invention and the method of installed the same, it is easy to install the canister, and it is possible to improve productivity.

Further, it is possible to implement smooth upward/downward movement of the canister, and to readily manage a degree of precision due to a simple structure.

Further, it is possible to stably guide the upward/downward movement of the canister and to stably support the canister in the trunk.

Further, it is possible to stably form a waterproof structure between the canister and the hull.

In addition, it is possible to improve durability or reliability of the canister type thruster and each unit included in it.

DESCRIPTION OF DRAWINGS

FIG. 30 illustrates a modification of the restraint included in the canister type thruster according to the fourth embodiment of the present invention, wherein FIG. 30(*a*) is a perspective view illustrating the first locking member of the restrainer included in the canister type thruster, and FIG. 30(*b*) is a perspective view illustrating the locked rod of the restrainer included in the canister type thruster.

FIG. 31 is a perspective view illustrating the guide module used in a method of installing a canister type thruster according to an embodiment of the present invention.

FIG. 32 is a front view illustrating the guide module used in the method of installing a canister type thruster according to the embodiment of the present invention.

FIGS. 33 to 36 illustrate processes of installing the canister type thruster according to the embodiment of the present invention.

MODE FOR INVENTION

Hereinafter, embodiments of the present invention will be described in detail with reference to the accompanying drawings.

Figure 1:
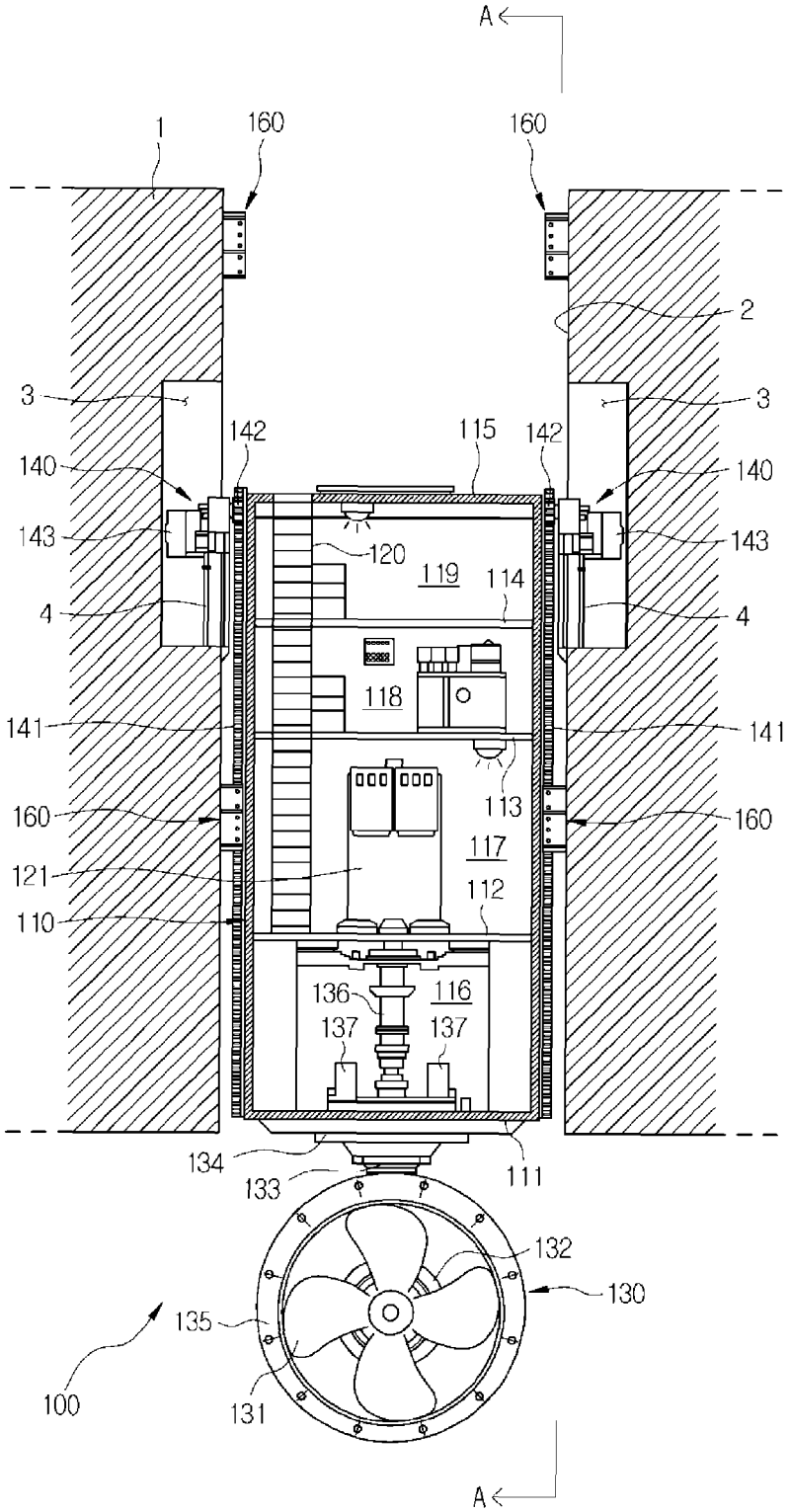
FIG. 1 is a sectional view illustrating a state in which a canister type thruster according to a first embodiment of the present invention is mounted in a hull.

FIGS. 1 to 10 are views illustrating a canister type thruster 100 according to a first embodiment of the present invention. FIG. 1 is a sectional view illustrating a state in which the canister type thruster 100 according to the first embodiment of the present invention is mounted in a hull.

The canister type thruster 100 according to the first embodiment of the present invention can be applied to ships or floating structures that need to maintain an anchored state in a marine work area. For example, the canister type thruster 100 can be applied to drillships that do drilling work for collecting submarine resources such as oil or gas or floating production storage offloading (FPSO) units. Further, this canister type thruster 100 can be applied to special ships such as towing vessels or icebreakers or typical transportation ships in addition to a case in which position control is always is required in an anchored state.

Figure 2:
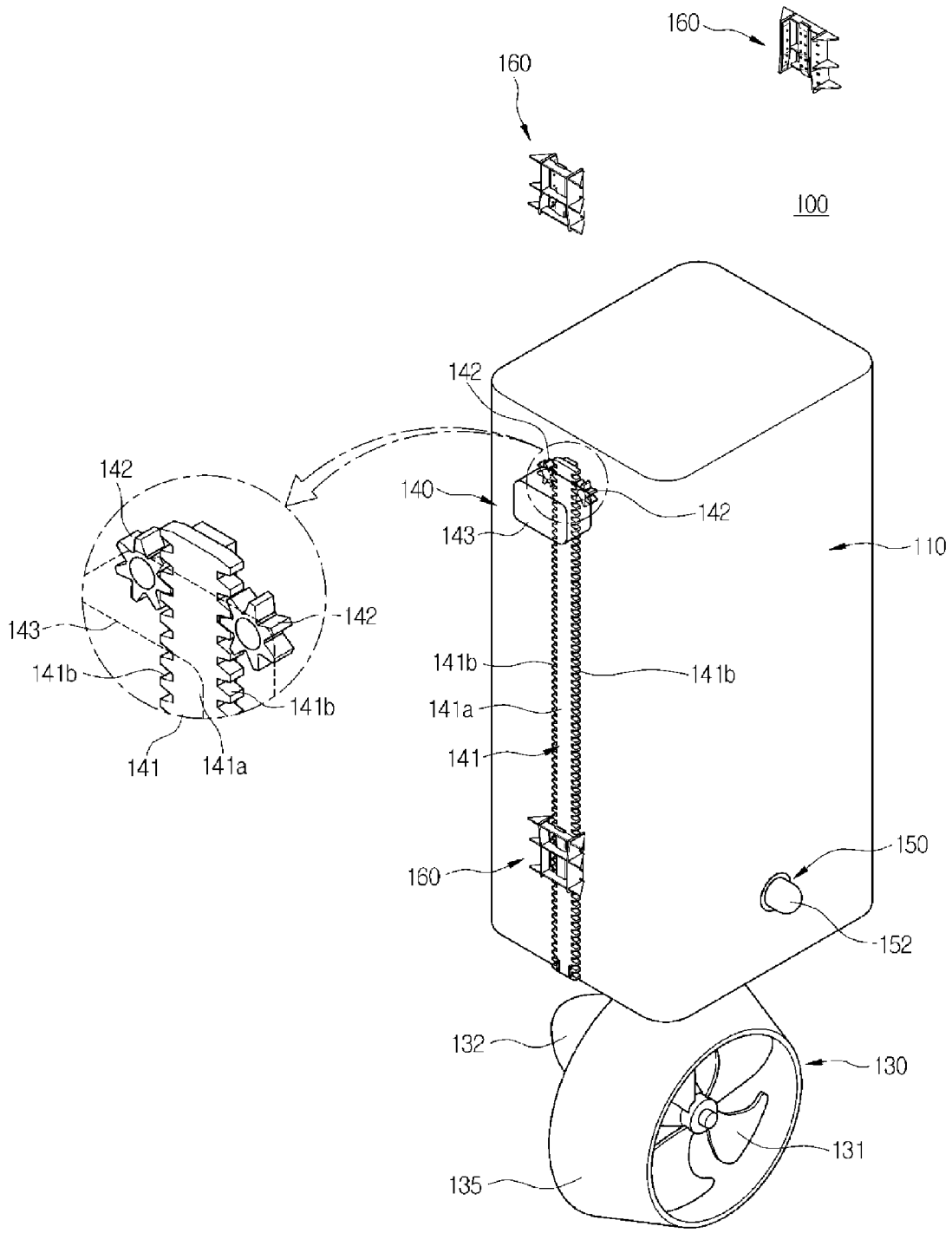
FIG. 2 is a perspective view illustrating the canister type thruster according to the first embodiment of the present invention.

Referring to FIGS. 1 and 2, a hull (or a floating structure) 1 of a ship to which the canister type thruster 100 is applied is equipped with a trunk 2 passing through the hull in an upward/downward direction. The canister type thruster 100 includes a canister 110 that is liftably installed in the trunk 2, a propellant head 130 that is installed at a lower portion of the canister 110, at least one lift unit 140 that moves the canister 110 up and down, and at least one guide module that guides upward/downward movement of the canister 110.

Figure 6:
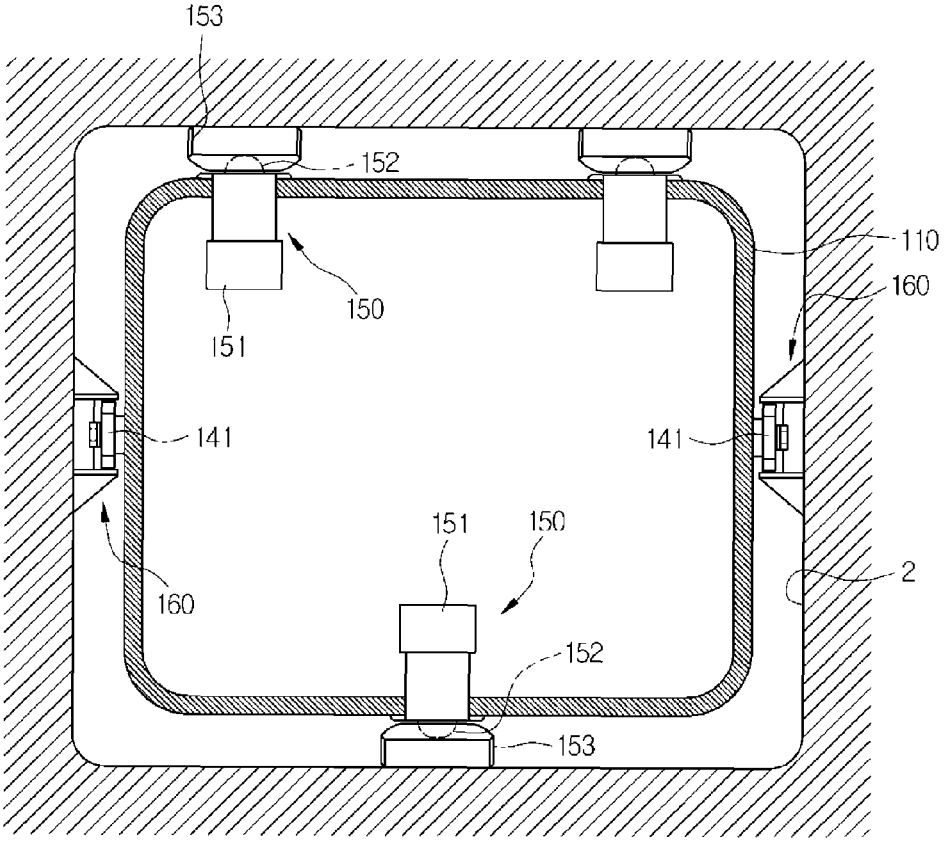
FIG. 6 is a cross sectional view illustrating a sectional structure of the canister type thruster according to the first embodiment of the present invention, a sectional structure of a trunk, and a configuration of a restrainer for restraining a canister.

As illustrated in FIGS. 1, 2 and 6, the canister 110 may be provided in the shape of a quadrilateral box whose lower and lateral portions can be waterproof. The trunk 2 of the hull 1 may have a slightly larger quadrilateral box shape than the canister 110. In the present embodiment, a state in which the canister type thruster 100 is applied when the canister 110 and the trunk 2 have quadrilateral cross-sectional shapes has been described, but the present embodiment is not limited thereto. It should be understood that the canister type thruster 100 is equally applied when the canister 110 and the trunk 2 have various cross-sectional shapes such as hexagonal shapes, octagonal shapes, or circular shapes.

As illustrated in FIG. 1, an interior of the canister 110 may be partitioned into a plurality of spaces by a plurality of decks 112, 113 and 114 separated from each other in an upward/downward direction. In detail, the interior of the canister 110 may be partitioned from the bottom of the canister 110 into a lower compartment 116 between a bottom plate 111 and a first deck 112, a main drive room 117 between the first deck 112 and a second deck 113, an auxiliary drive room 118 between the second deck 113 and a third deck 114, and an upper compartment 119 between the third deck 114 and a top plate 115. Further, the interior of the canister 110 may be provided with a long ladder 120 in an upward/downward direction so as to enable a worker to easily move to each space.

The main drive room 117 is provided with a driving motor 121 that drives the propellant head 130 be described below. The auxiliary drive room 118 may be provided with various control systems for controlling an operation of the canister type thruster 100 and a power supply system. Here, the internal configuration of the canister 110 is merely given as an example to help in understanding the present invention, but it is not limited thereto. The interior of the canister 110 may be variously modified as needed.

Figure 3:
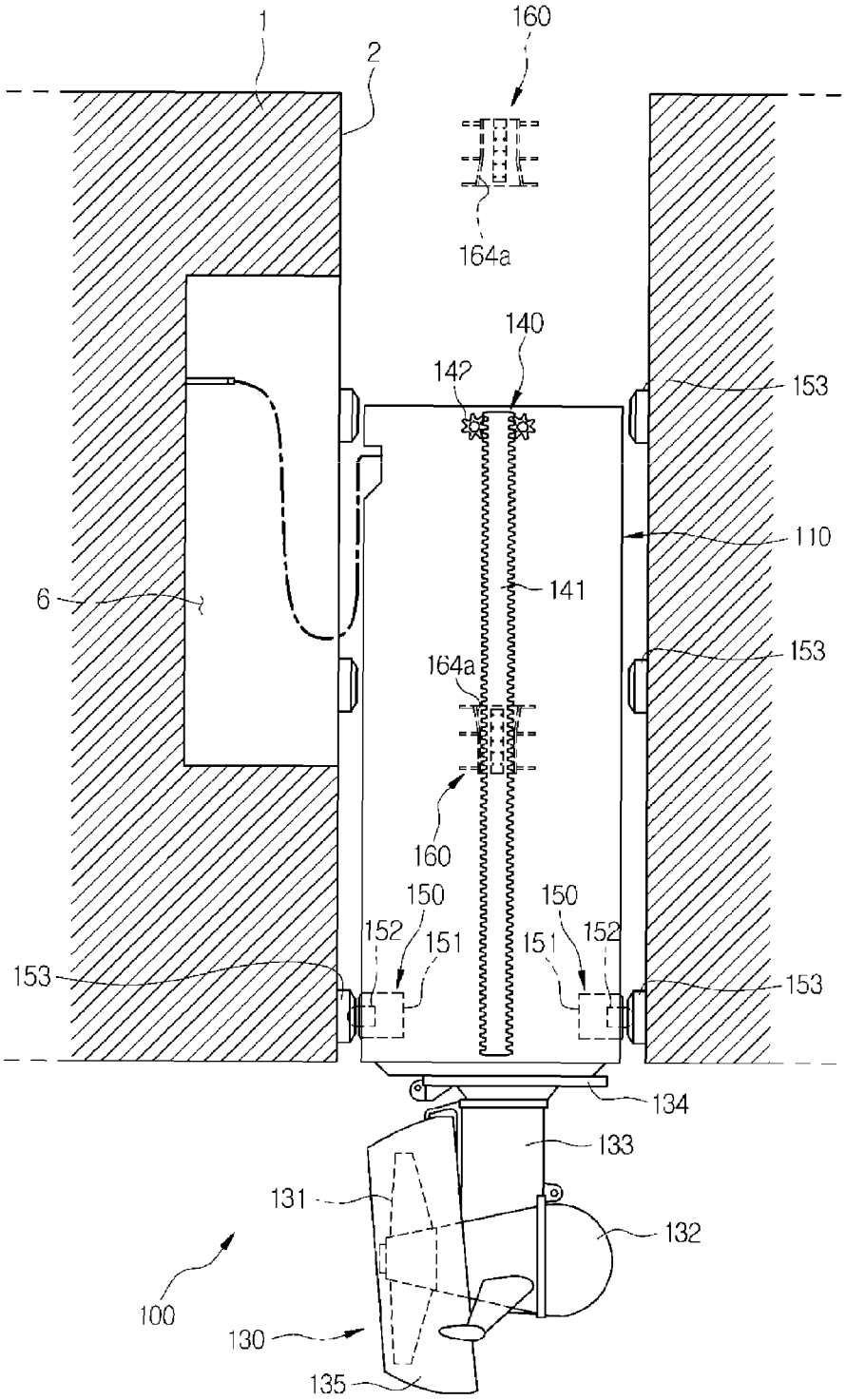
FIGS. 3 to 5 are sectional views taken along line A-A of FIG. 1, and illustrate states in which the canister type thruster according to the first embodiment of the present invention moves to respective positions for an operation mode, a movement mode, and a maintenance mode.
Figure 4:
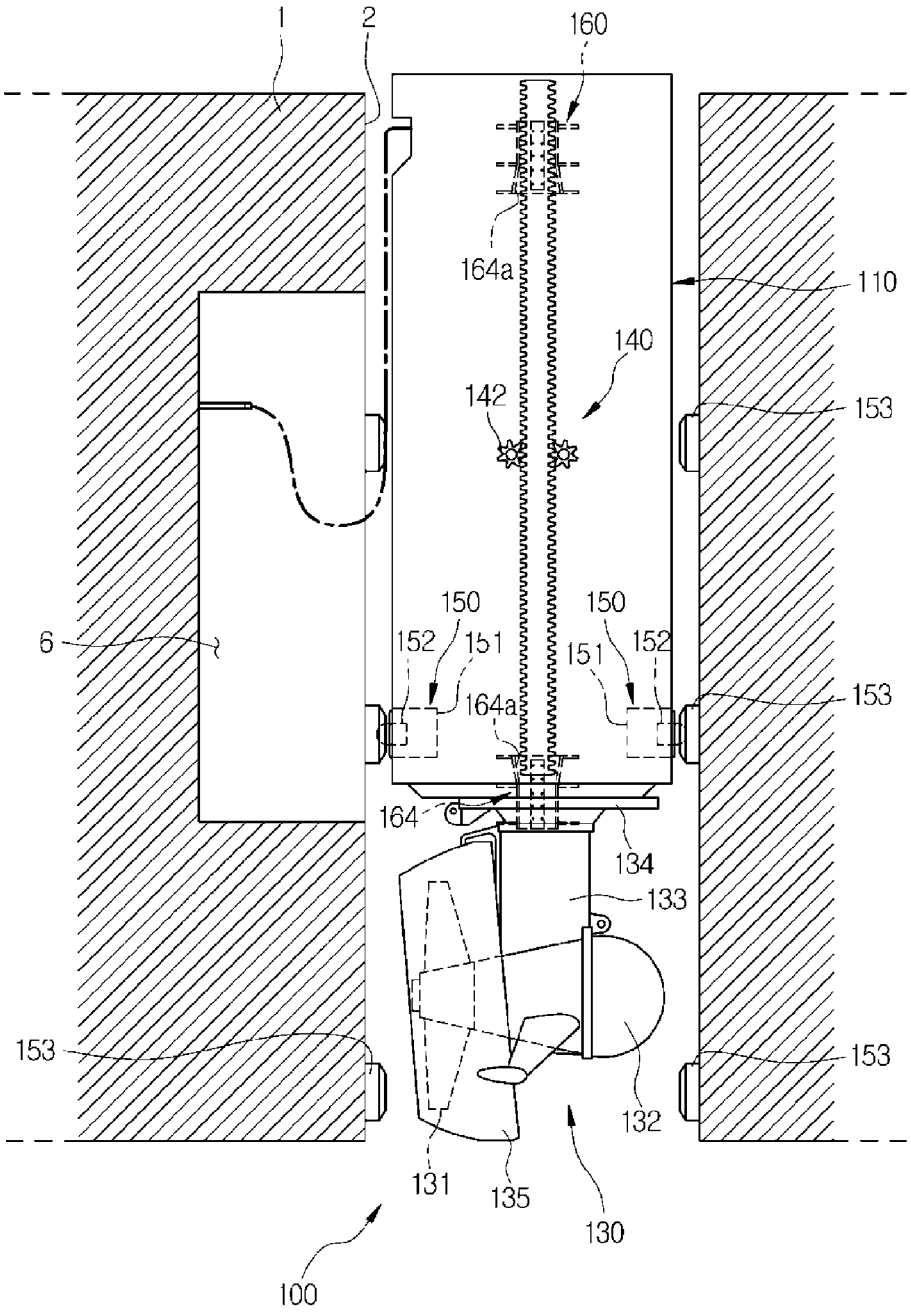

As illustrated in FIGS. 1 to 3, the propellant head 130 may include a propeller 131, a streamlined propeller support 132 that supports the propeller 131, a vertical support 133 which extends upward from the propeller support 132 and at an upper portion of which a rotary joint 134 is rotatably supported by the bottom plate 111 of the canister 110, and a cylindrical shroud 135 that is installed around the propeller 131 to guide a propellant flow of water.

A driving shaft 136 that transmits a rotational force of the driving motor 121 to the propeller 131 is installed in the lower compartment 116 of the canister 110. Although not illustrated, rotary shafts and gears that connect the driving shaft 136 and the propeller 131 to enable power transmission are installed in the vertical support 133 and the propeller support 132 of the propellant head 130. Further, a plurality of steering motors 137 rotating the rotary joint 134 to allow the propellant head 130 to be rotated within an angle of 360 degrees may be installed in the lower compartment 116.

As illustrated in FIGS. 1 and 3, the propeller 131 is rotated by an operation of the driving motor 121, and thereby the propellant head 130 can generate the propellant flow of water below the bottom of the hull 1. Further, when the propellant head 130 is rotated by operations of the steering motors 137, a direction of the propellant flow of water can be controlled. This propellant flow of water moves the hull 1 to a desired position, and thereby the hull 1 can be maintained in place on the sea in spite of the influence of tides, waves, and so on. In this way, such a thruster that the propellant head 130 is rotated below the hull 1 is called an azimuth thruster.

As illustrated in FIGS. 1 to 3, the lift unit 140 moving the canister 110 up and down may be installed between an outer surface of the canister 110 and an inner surface of the trunk 2. Further, lift units 140 having the same configurations may be provided at respective opposite sides of the canister 110 so as to allow the canister 11 to move up and down on equal conditions at the opposite sides of the canister 110.

Each of the lift units 140 may include a rack 141 that is fixed on an outer surface of the canister 110 and is formed to extend in parallel in an upward/downward direction, a pair of pinions 142 that are installed on an inner surface of the trunk 2 and are engaged with the rack 141 at opposite sides of the rack 141, and a lift drive 143 that drives the pinions 142.

As illustrated in FIGS. 2 and 3, the rack 141 extends from an upper portion to a lower portion of the outer surface of the canister 110 so as to be in parallel with the upward/downward direction, and is provided with toothed parts 141*b* that are engaged with the pair of pinions 142 at opposite sides thereof in a width direction so as to be symmetrical. In the present embodiment, to implement stable upward/downward movement, the pair of pinions 142 are configured to be engaged with the respective opposite toothed parts 141*b* of the rack 141. However, the rack 141 may be provided with one toothed part 141*b* only on one side thereof, and one pinion 142 may be engaged with the one toothed part 141*b*. Further, in the present embodiment, lateral portion 141*a* of the rack 141 and the toothed parts 141*b* of the opposite sides of the rack 141 are integrally formed, but the lateral portion 141*a* and the toothed parts 141*b* may be separated formed and then mutually coupled. Further, the rack 141 is configured to implement upward/downward movement of the canister 110 that is a long large component as a huge structure, and thus may be configured in such a manner that a plurality of components are separately manufactured and then mutually coupled.

As illustrated in FIG. 1, the lift drives 143 may be installed at positions higher than the middle of the trunk 2, and installation spaces 3 used for installation and maintenance of the lift drives 143 may be provided at opposite sides of the inner surface of the trunk 2 at which the lift drives 143 are located. A driving source of each of the lift drives 143 may be made up of a reduction gearbox and a motor driving the reduction gearbox such that the pair of pinions 142 can be rotated at a reduced speed in the opposite directions, and may be fixed to a stationary structure 4 in each of the installation space 3.

The rack 141 is lifted or lowered by the operations of the lift drives 143, and thereby the lift units 140 can implement upward/downward movement of the canister 110. As a result, it is possible to change a position of the propellant head 130 installed below the canister 110. That is, it is possible to convert a mode of the canister type thruster 100 into any one of an operation mode of locating the propellant head 130 below the bottom of the hull 1 to control the position of the hull 1 as in FIG. 3, a movement mode of pulling up the propellant head 130 into the trunk 2 to reduce resistance when the hull 1 moves as in FIG. 4, and a maintenance mode of pulling up the propellant head 130 to a maintenance space 6 at an upper portion of the trunk 2 for the purpose of maintenance of the propellant head 130 as in FIG. 5.

Figure 5:
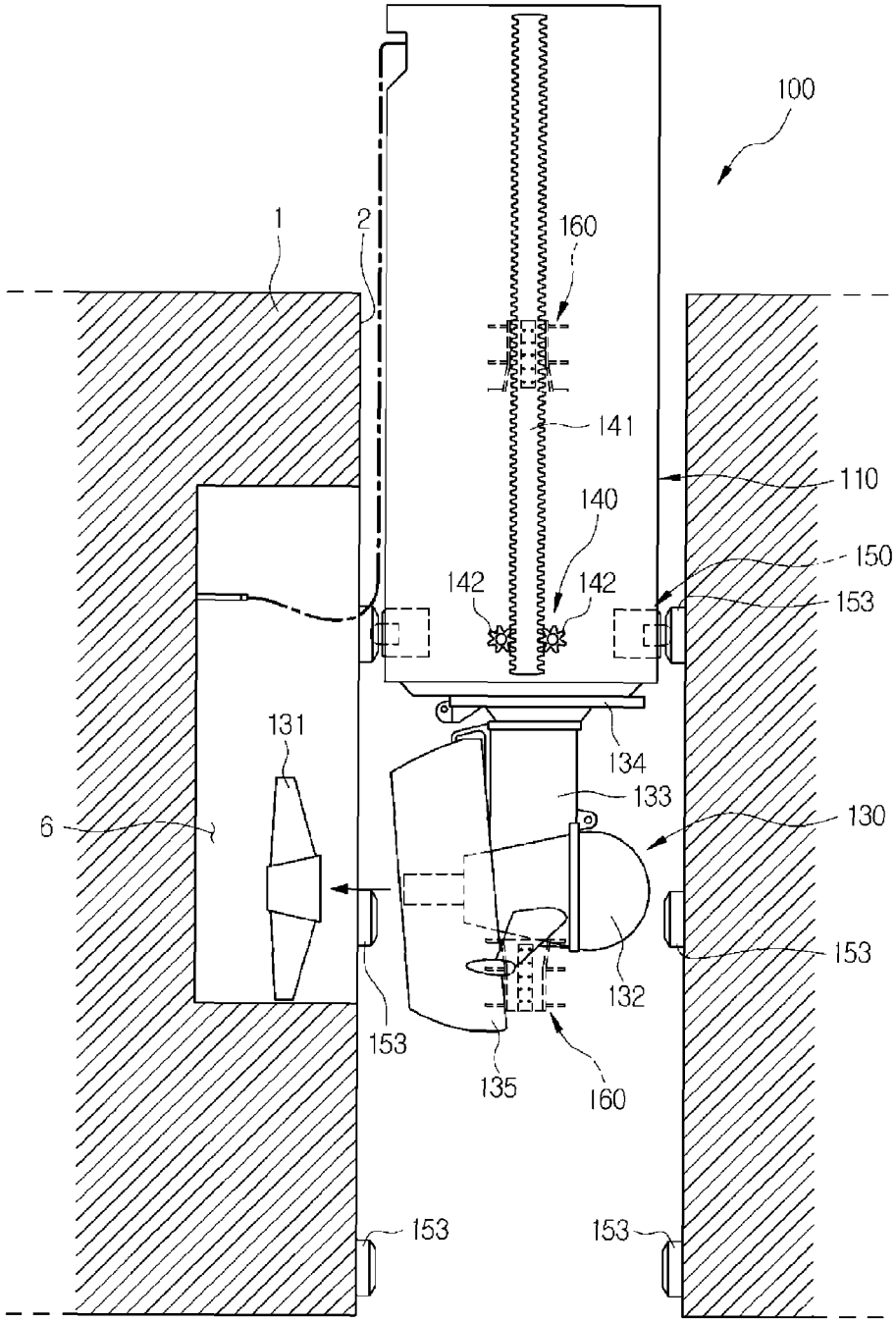

As illustrated in FIG. 5, the maintenance space 6 for the maintenance of the propellant head 130 may be provided in the inner surface of the trunk 2 which is at a height at which the propellant head 130 is located in the maintenance mode. The maintenance space 6 may have enough size to disassemble components of the propellant head 130 and then store the disassembled components in the maintenance space 6 or to enable a worker to approach the propellant head 130 to perform maintenance, and may be located above the seal level in a state in which the ship has been launched.

As illustrated in FIGS. 3 to 6, this canister type thruster 100 is provided with a plurality of restraints 150 that can restrain the canister 110 without arbitrary movement in a state in which the mode thereof is converted into the operation mode, the movement mode, or the maintenance mode.

Each of the restraints 150 may include a driver 151 that is installed in the canister 110 and is implemented as a motor or a hydraulic cylinder, a locked rod 152 that protrudes outward from the canister 110 to be locked by an operation of the driver 151, and a locking member 153 that is fixed to the inner surface of the trunk 2 at a position corresponding to that of the locked rod 152 and has a recess into which the locked rod 152 is fitted and locked. The plurality of locking members 153 may be provided at the respective positions corresponding to the locked rods 152 such that the locked rods 152 can be locked in the state in which the mode of the canister type thruster 100 is converted into the operation mode, the movement mode, or the maintenance mode.

Figure 7:
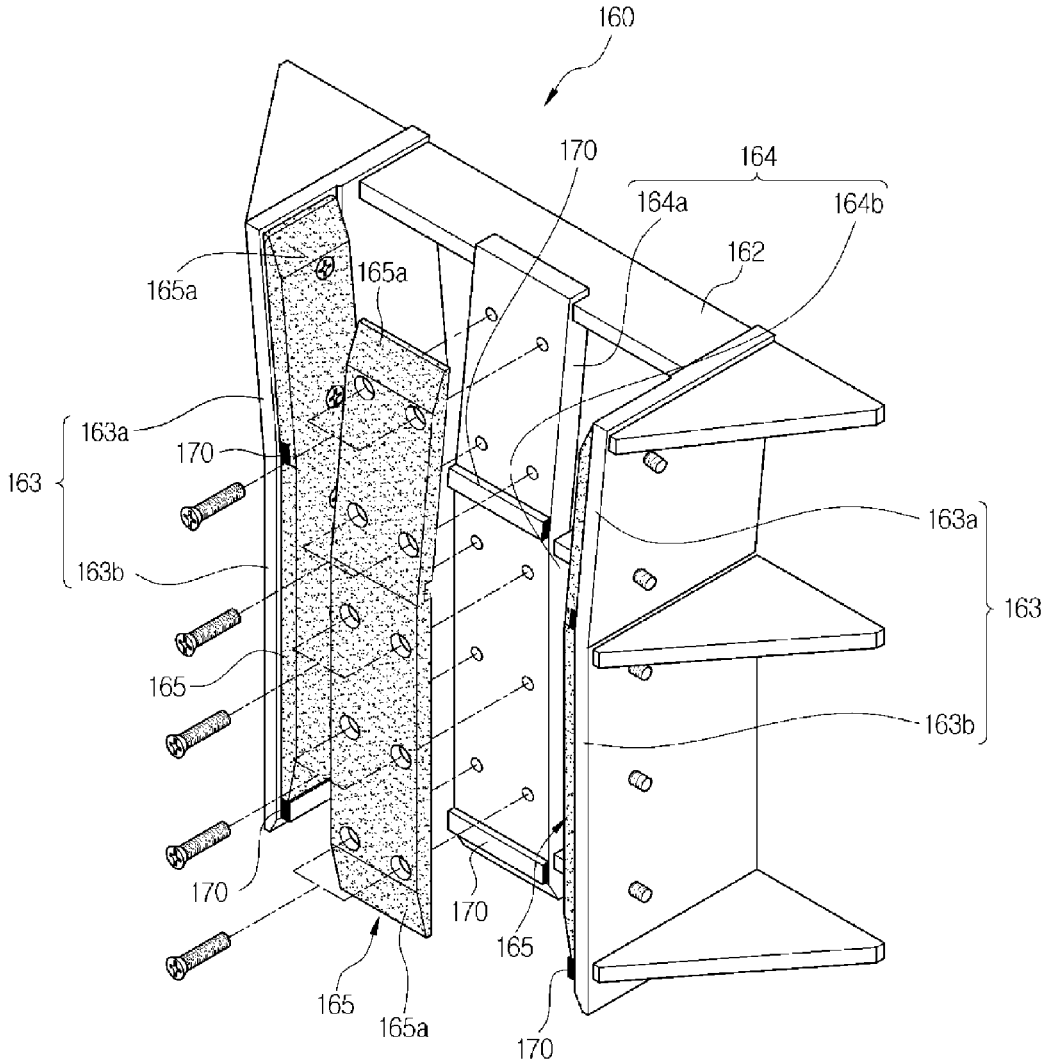
FIG. 7 is a perspective view illustrating a guide module included in the canister type thruster according to the first embodiment of the present invention.

As illustrated in FIG. 7, the guide module for guiding the upward/downward movement of the canister 110 may be provided with a guide unit 160 that is installed on the inner surface of the trunk 2 and supports the rack 141 to guide the upward/downward movement of the canister 110, sliding pads 165 that relieve an impact or a friction applied to the guide unit 161, and support steps 170 that are provided between the guide unit 161 and the sliding pads 165 to prevent separation of the sliding pads 165. Referring to FIGS. 1 and 2, the guide module includes an upper guide unit 160 that is installed on the inner surface of the trunk 2 above the lift drive 143 and a lower guide unit 160 that is installed on the inner surface of the trunk 2 below the lift drive 143. The upper guide unit 160 and the lower guide unit 160 are mounted on the inner surface of the trunk 2 so as to be matched with an upward/downward track of the rack 141 and slidably support the rack 141 to guide smooth upward/downward movement of the canister 110. Hereinafter, to help understanding of the present invention, an example in which the guide module is constituted of the upper guide unit 160 and the lower guide unit 160 will be described, but the present invention is not limited thereto. It should be understood that an upper guide unit 260 (see FIG. 12) or the lower guide unit 160 is additionally installed on the upward/downward track of the rack 141.

Figure 8:
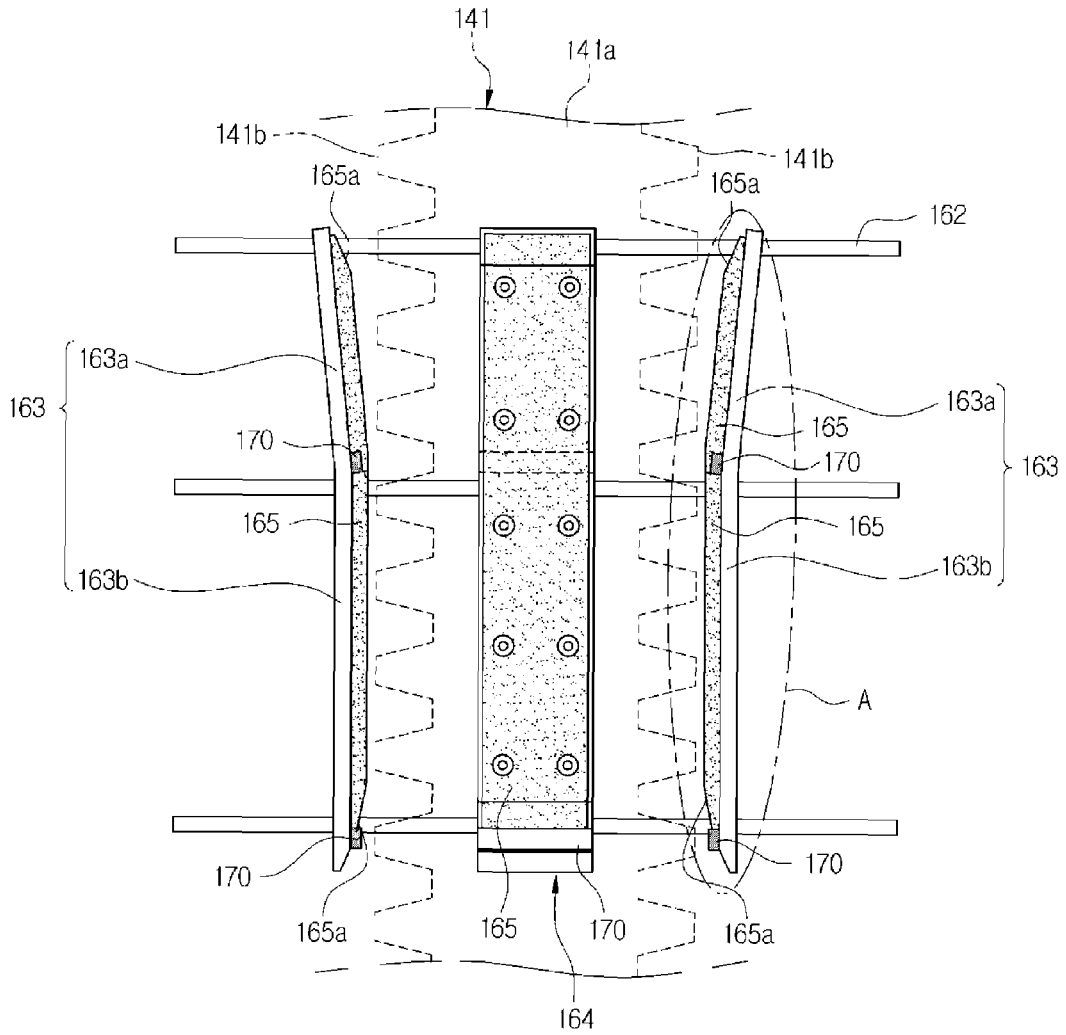
FIG. 8 is a front view illustrating a guide module included in the canister type thruster according to the first embodiment of the present invention.

As illustrated in FIGS. 2, 7 and 8, the guide unit 161 included in the lower guide unit 160 includes a support bracket 162 that is fixed to the inner surface of the trunk 2, two toothed-part guides 163 that are symmetrically provided at opposite sides of the support bracket 162 and are in contact with the toothed parts 141*b* at the opposite sides of the rack 141, and a lateral guide 164 that is provided for the support bracket 162 between the two toothed-part guides 163 so as to come into contact with a lateral surface (a flat surface free of the toothed part) of the rack 141 to guide the upward/downward movement of the rack 141. The guide unit 161 is formed in a C shape in which the two toothed-part guides 163 and the lateral guide 164 surround the rack 141, and thereby it can support the rack 141 without arbitrary movement.

The support bracket 162 constituting frames of the two toothed-part guides 163 and the lateral guide 164 may be manufactured by welding a plurality of metal plates. The support bracket 162 may be fixed to the inner surface of the trunk 2 by welding.

The sliding pads 165 for relieving the applied impact or friction by supporting the rack 141 are provided for the two toothed-part guides 163 and the lateral guide 164. Each of the sliding pads 165 may be mounted on inner surfaces of the toothed-part guides 163 and the lateral guide 164 so as to be able to be coupled or decoupled by bolting, and thereby can be replaced in the event of wear or damage.

The toothed-part guides 163 and the lateral guide 164 may be provided with entry guides 163*a* and 164*a* inclined with respect to a lifting direction of the rack 141 such that the rack 141 can smoothly enter, and upper and lower ends of the sliding pads 165 may be formed with oblique guide faces 165*a* inclined with respect to the lifting direction of the rack 141.

The sliding pads 165 may be formed of a non-metallic material having weaker rigidity than the rack 141 so as to be able to protect the toothed parts 141*b* of the rack 141 as well as smoothly guide sliding movement of the toothed parts 141*b*, and preferably is a synthetic resin material having low frictional resistance, high wear resistance, and high impact resistance.

Figure 9:
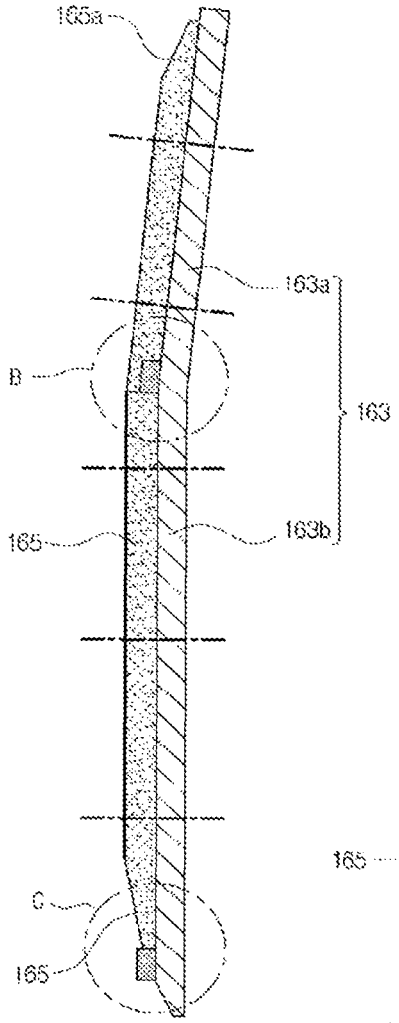
FIG. 9(*a*) is an enlarged front view illustrating a portion A of FIG. 8, FIG. 9(*b*) is a front view illustrating an enlarged coupled state of a portion B of FIG. 9(*a*), and FIG. 9(*c*) is a front view illustrating an enlarged coupled state of a portion C of FIG. 9(*a*).
Figure 9:
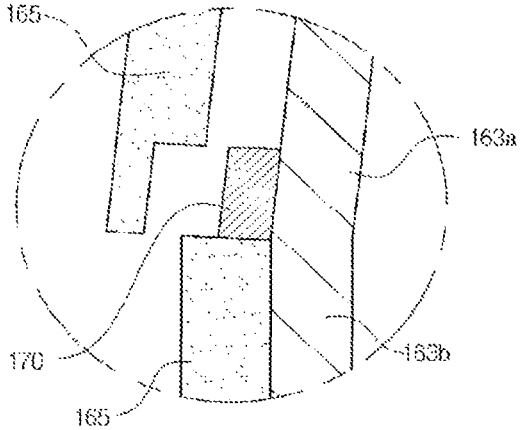
Figure 9:
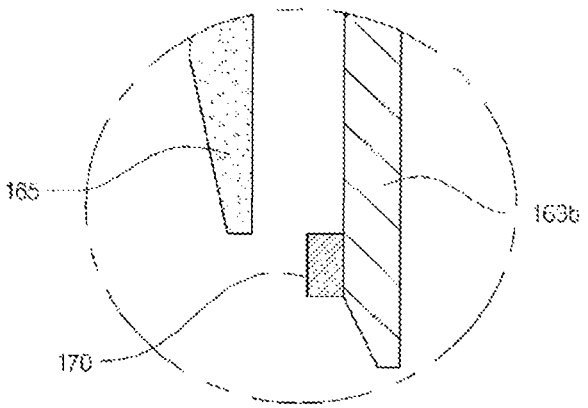

As illustrated in FIG. 9, the support steps 170 are provided between the toothed-part guides 163 and the lateral guide 164 of the support bracket 162 and the sliding pads 165, and can prevent separation of the sliding pads 165 when the rack 141 enters the lower guide unit 160.

The support steps 170 are provided to protrude from front surfaces of the toothed-part guides 163 and the lateral guide 164, and thereby a safety factor of the lower guide unit 160 can be secured by a method of supporting the sliding pads 165. Especially, considering that stress is concentrated on regions at which the entry guides 163*a* and 164*a* of the toothed-part guides 163 and the lateral guide 164 meet lifting guides 163*b* and 164*b* parallel with the lifting direction when the rack 141 enters, when the support steps 170 are provided between the entry guides 163*a* and 164*a* and the lifting guides 163*b* and 164*b*, the safety factor of the lower guide unit 160 can be secured more efficiently.

FIG. 9(*c*) is an enlarged sectional view illustrating a portion C of FIG. 9(*a*). Referring to FIG. 9(*c*), when the support steps 170 are provided at lower ends of the front surfaces of the toothed-part guides 163 and the lateral guide 164, the safety factor of the lower guide unit 160 can be secured, and upon replacing the sliding pads 165, the replacing work can be performed with lower end faces of the sliding pads 165 caught on the support steps 170, and thus the degree of difficulty of the replacing work can be remarkably reduced. This is because, since the sliding pads 165 correspond to giant structures having a width and height of about 1 meter, the replacing work is performed in a state in which the sliding pads 165 are caught on the lower ends of the front surfaces of the toothed-part guides 163 and the lateral guide 164 as described above, the degree of fatigue of the replacing work can be reduced.

The support steps 170 may be fixedly installed on the toothed-part guides 163 and the lateral guide 164 by a fastening method such as welding or bolting. Thereby, the sliding pads 165 are additionally fixed and supported by bolting between the sliding pads 165 and the toothed-part guides 163 and the lateral guide 164 as well as wedging based on the support steps 170. Thereby, when the canister 110 moves up and down, it is possible to efficiently prevent the separation of the sliding pads 165.

Figure 10:
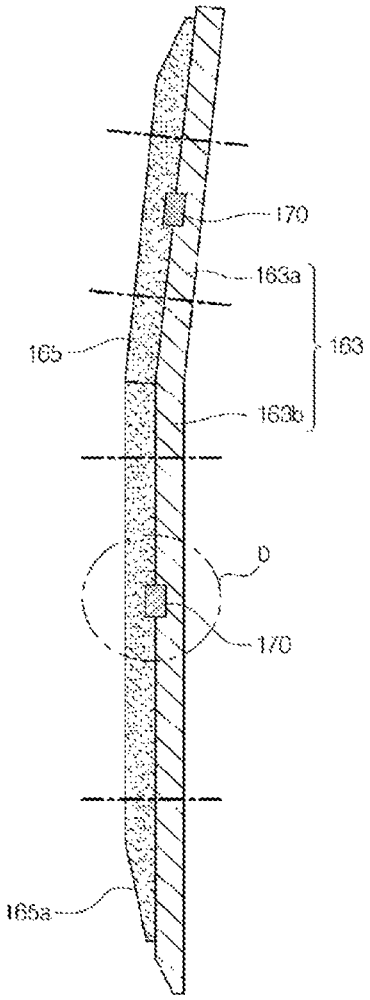
FIG. 10(*a*) illustrates a modification of the first embodiment of the present invention and is a front view illustrating a state in which support steps are inserted into a lateral guide and a sliding pad of the guide module included in the canister type thruster, and FIG. 10(*b*) is a front view illustrating an enlarged coupled state of a portion D of FIG. 10(*a*).
Figure 10:
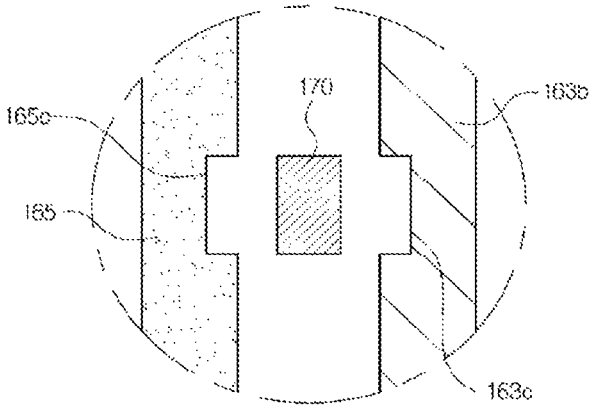

As a modification of the canister type thruster according to the first embodiment of the present invention, as illustrated in FIG. 10, the front surfaces of the toothed-part guides 163 and/or the lateral guide 164 may be provided with support grooves 163*c* and/or 164*c* into which the support steps 170 are inserted to a predetermined depth. Rear surfaces of the sliding pads 165 are provided with support grooves 165*c* at positions opposite to the support grooves 163*c* and/or 164*c*. Thereby, the support steps 170 can be partly inserted into the support grooves 163*c* and/or 164*c* provided in the toothed-part guides 163 and/or the lateral guide 164 to a predetermined depth, and can also be partly inserted into the support grooves 165*c* provided in the sliding pads 165. Thereby, the sliding pads 165 are additionally fixed and supported by bolting between the sliding pads 165 and the toothed-part guides 163 and the lateral guide 164 as well as wedging based on the support steps 170 inserted into the support grooves 163*c*, 164*c* and 165*c*. Thereby, it is possible to more efficiently prevent the separation of the sliding pads 165.

As described above, the numerous support steps 170 may be provided between the guide unit 161 and the sliding pads 165. When the support steps 170 are inserted into the support grooves 163*c*, 164*c* and 165*c* that are provided in the front surfaces of the toothed-part guides 163 and the lateral guide 164 and in the rear surface of the sliding pads 165, lengths of the support steps 170 and the support grooves 163*c*, 164*c* and 165*c* are provided to be shorter than those of the toothed-part guides 163 and the lateral guide 164 so as to be able to fix and support the sliding pads 165.

The upper guide unit 160 may also be provided substantially in the same form as the lower guide unit 160. However, considering that, when the canister 110 moves up or down, the rack 141 comes out of and renters the upper guide unit 160 or the lower guide unit 160, the entry guides 163*a* and 164*a* for guiding the entry of the rack 141 in an inclined state may be set in the opposite directions. That is, as illustrated in FIG. 3, the entry guides 164*a* may be disposed at a lower portion of the upper guide unit 160, and the entry guides 164*a* may be disposed at an upper portion of the lower guide unit 160.

A separation distance between the upper guide unit 160 and the lower guide unit 160 may be shorter than the full length of the rack 141. This is intended to realize the stable upward/downward movement of the rack 141 by causing the rack 141 to be liftably supported by the upper guide unit 160 and the pinions 142 of the lift drive 143 as illustrated in FIG. 5 or by the lower guide unit 160 and the pinions 142 of the lift drive 143 as illustrated in FIG. 3, i.e. by maintaining at least two point supports.

When this canister type thruster 100 is first installed in the hull 1 or is decoupled from the hull 1 to fix a problem and then is again coupled to the hull 1, the canister 110 equipped with the propellant head 130 is hoisted by a crane, and then is lowered to enter an upper opening of the trunk 2.

At this time, the racks 141 of the opposite sides of the canister 110 are guided for entry by the upper guide unit 160, and then are engaged with the pinions 142 of the lift drives 143 located below the racks so as to be stably supported. Afterwards, the canister 110 can be guided by operations of the lift drives 143, and the descending racks 141 can be naturally guided into the lower guide unit 160 so as to be stably supported.

Particularly, since the upper guide unit 160 and the lower guide unit 160 are disposed on the same line as the rack 141 and guide the rack 141, the canister type thruster 100 according to the first embodiment of the present invention can be easily installed compared to typical canister type thrusters in which the guide units and the lift units are disposed at different positions. The support steps 170 are provided between the toothed-part guides 163 and the lateral guide 164 and the sliding pads 165 that are provided for the support bracket 162 of the guide unit 161, and thereby the upward/downward movement of the canister 110 is guided by the guide module in which the safety factor is secured. Thus, the separation of the sliding pads 165 is efficiently prevented, and durability of the guide module is improved. When the support steps 170 are provided at the lower ends of the front surfaces of the toothed-part guides 163 and/or the lateral guide 164, the degree of difficulty of the replacing work of the sliding pads 165 can be remarkably reduced.

FIGS. 11 to 14 illustrate a canister type thruster 200 according to a second embodiment of the present invention.

Unless otherwise indicated or described by separate numerals or symbols, components of the canister type thruster 200 according to the second embodiment of the present invention are substantially the same as those of the canister type thruster 100 according to the first embodiment of the present invention, and so duplicate description thereof will be omitted.

Figure 11:
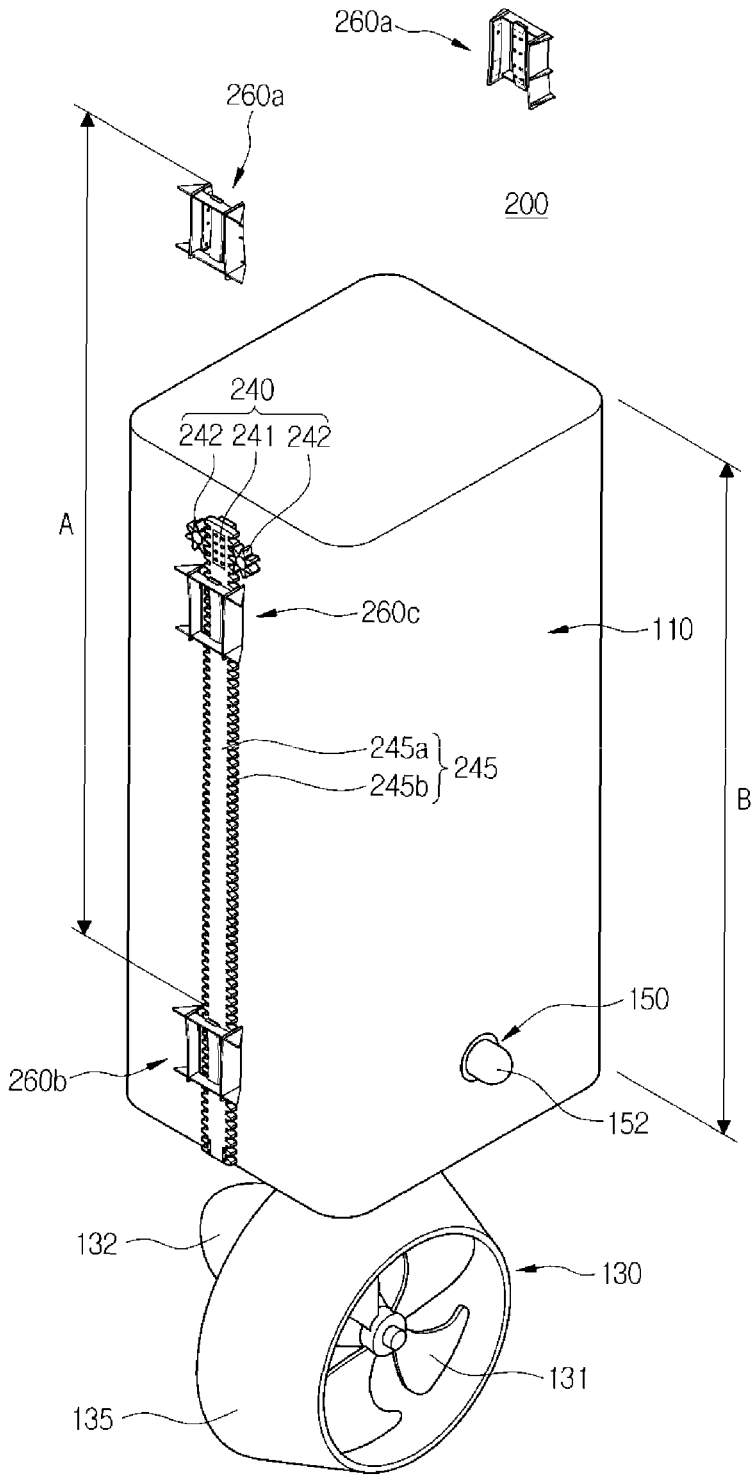
FIG. 11 is a perspective view illustrating a canister type thruster according to a second embodiment of the present invention.

FIG. 11 is a perspective view of the canister type thruster 200 according to the second embodiment of the present invention.

As illustrated in FIG. 11, the canister type thruster 200 according to the second embodiment of the present invention includes a guide module that guides upward/downward movement of a canister 110. Since numerous guide units 260 and lift units 240 are disposed on the same axis on which racks 245 of the canister 110 are disposed, manufacturing work of the guide module is easy, and smooth upward/downward movement of the canister type thruster 200 can be implemented. Here, the plurality of guide units 260 may include upper guide units 260*a*, lower guide units 260*b*, and intermediate guide units 260*c*.

To be specific, when the canister 110 is lowered in a trunk 2 of the hull 1, the lower guide units 260*b* are disposed at a lower portion of the trunk 2 facing the racks 245 installed on an outer surface of the canister 110 in a lifting direction, and thereby can guide the racks 245 in a downward direction of the trunk 2 of the hull 1.

The lower guide units 260*b* have C-shaped guide structures, each of which encloses each of the racks 245 in part, and may be disposed to correspond to the pair of racks 245 located at opposite sides of the canister 110 respectively.

When the canister 110 is raised in the trunk 2 of the hull 1, the upper guide units 260*a* are disposed at an upper portion of the trunk 2 facing the racks 245 installed on the outer surface of the canister 110 in the lifting direction, and thereby can guide the racks 245 in an upward direction of the trunk 2 of the hull 1.

Like the lower guide units 260*b*, the upper guide units 260*a* may be formed in C-shaped guide structures, each of which encloses each of the racks 245 in part, and be disposed to correspond to the pair of racks 245 located at opposite sides of the canister 110 respectively.

Figure 12:
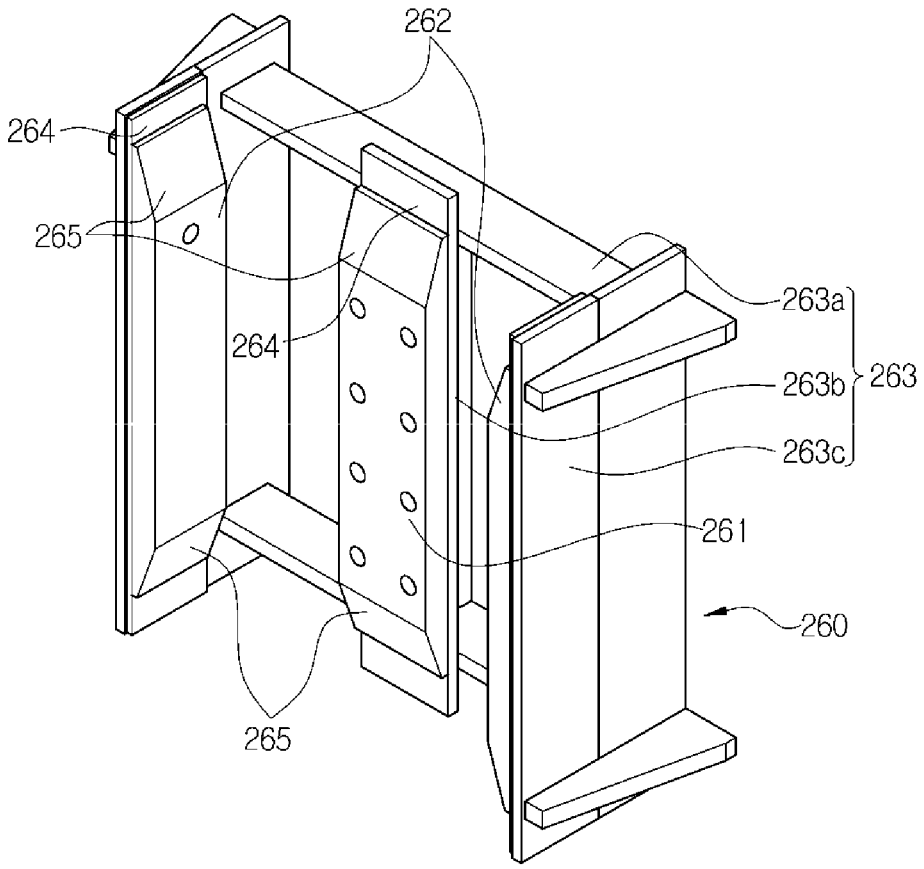
FIG. 12 is a perspective view illustrating a guide unit of a guide module included in the canister type thruster according to the second embodiment of the present invention.

Referring to FIG. 12, each of the upper guide units 260*a* may include a guide bracket 263, a lateral guide pad 261, and toothed-part guide pads 262. Here, the guide bracket 263, the lateral guide pad 261, and the toothed-part guide pads 262 have substantially the same configurations as the guide bracket 263, the lateral guide pad 261, and the toothed-part guide pads 262 constituting the aforementioned lower guide unit 260*b*, and thus description of the configurations and operations thereof will be omitted. Like numbers may be given like components.

However, unlike the upper guide units 260*a*, the lower guide units 260*b* are located at a lower portion of an inner surface of the trunk 2 of the hull 1. Tapered surfaces 265 formed at upper and lower portions of the lateral guide pad 261 and the toothed-part guide pads 262 can guide each of the racks 245 into easy entry to a space defined by the lateral guide pad 261 and the toothed-part guide pads 262 in the maintenance mode.

Further, a maximum distance A between the upper guide unit 260*a* and the lower guide unit 260*b* may be designed to be at least shorter than a maximum distance B of the rack 245. Thereby, the rack 245 can secure stable upward/downward movement through a minimum of two point supports by means of the lift unit 240 and the lower guide unit 260*b* or the lift unit 240 and the upper guide unit 260*a*.

The lift unit 240 supplies the rack 245 with a driving force according to an operation or maintenance mode, and thereby can move the rack 245 relative to the trunk 2 of the hull 1 in an upward/downward direction and simultaneously guide movement of the rack 245.

To this end, the lift unit 240 may include a lift guide pad 241 that is located opposite to the rack 245 and maintains a predetermined gap from the rack 245, pinions 242 that are located opposite to opposite toothed parts 245*b* of the rack 245 and are engaged with the toothed parts 245*b* of the rack 245, and a motor (not shown) that is connected to the pinions 242 so as to be able to drive the pinions 242.

Referring to FIG. 11, each of the guide units 260 may further include the intermediate guide unit 260*c*. The intermediate guide unit 260*c* is disposed on the same axis as the lift unit 240 and the lower guide unit 260*b*, and can guide the rack 245 within the trunk 2 of the hull 1 in the upward/downward direction.

Figure 13:
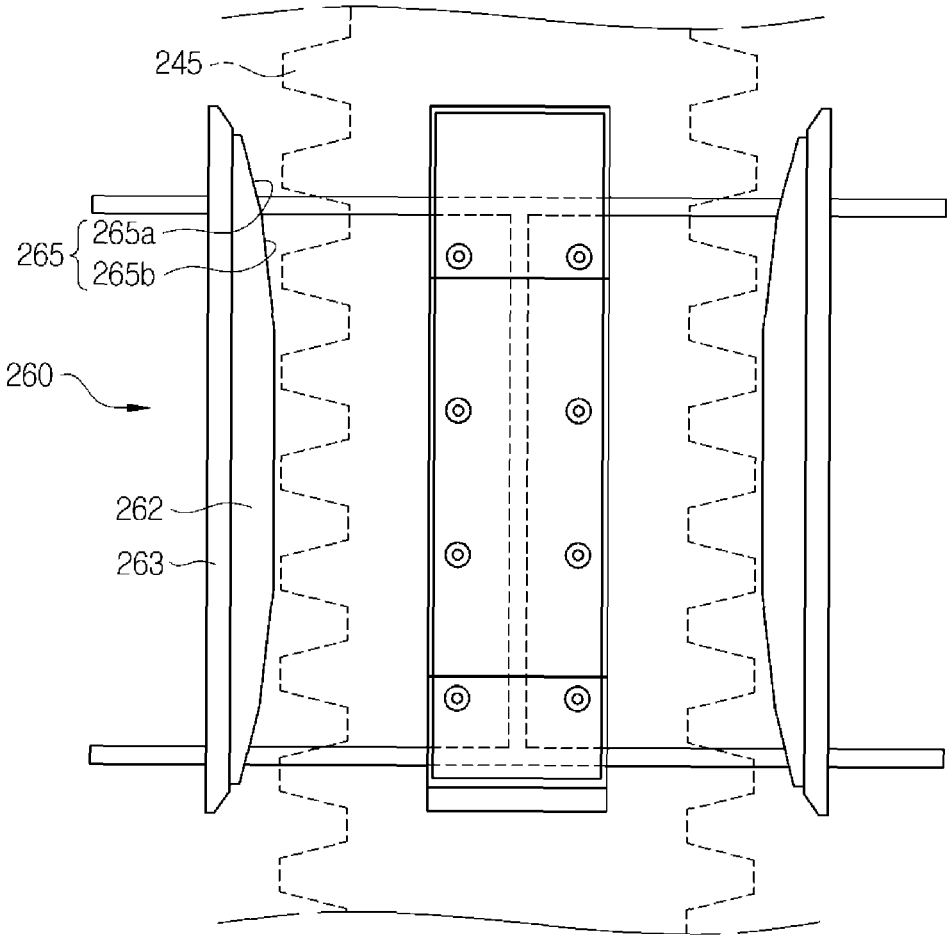
FIG. 13 is a perspective view illustrating the guide unit of the guide module included in the canister type thruster according to the second embodiment of the present invention.

FIG. 12 is a perspective view illustrating the guide unit 260 included in the guide module constituting the canister type thruster 200 according to the second embodiment of the present invention. FIG. 13 is a front view illustrating the guide unit 260 of the guide module constituting the canister type thruster 200 according to the second embodiment of the present invention.

The guide unit 260 may include the guide bracket 263 that is fixedly installed on the inner surface of the trunk 2 of the hull 1, the lateral guide pad 261 that is provided for the guide bracket 263 so as to maintain a predetermined gap from a lateral portion 245*a* of the rack 245, and the toothed-part guide pads 262 that are provided for the guide bracket 263 so as to be paired opposite to the toothed parts 245*b* of the rack 245. Here, the guide bracket 263 may be made up of support frames 263*a*, a front frame 263*b*, and lateral frames 263*c*.

For example, the support frames 263*a* are frames mounted on the inner surface of the trunk 2 of the hull 1. The front frame 263*b* disposed opposite to the lateral portion 245*a* of the rack 245 may be installed on the support frames 263*a*, and the lateral frames 263*c* may be disposed at opposite ends thereof in a vertical direction. The lateral guide pad 261 maintaining a predetermined gap from the lateral portion 245*a* of the rack 245 may be attached to one surface of the front frame 263*b*. In addition, the lateral frames 263*c* are disposed at the opposite ends of the support frames 263*a* in the vertical direction, and are paired to face the toothed parts 245*b* of the rack 245. The toothed-part guide pads 262 maintaining predetermined gaps from the toothed parts 245*b* of the rack 245 may be attached to the surfaces of the lateral frames 263*c* which face the toothed parts 245*b* of the rack 245.

A thickness adjusting plate 264 may be selectively interposed between the lateral guide pad 261 and the front frame 263*b*, or other thickness adjusting plates 264 may be selectively interposed between the toothed-part guide pads 262 and the lateral frames 263*c*. Each of the thickness adjusting plates 264 is a gap maintaining plate having a predetermined thickness. The number of thickness adjusting plates 264 is adjusted between the lateral guide pad 261 and the front frame 263*b* or between each of the toothed-part guide pads 262 and each of the lateral frames 263*c*, and thereby can be adjusted to a minute tolerance between the lower guide unit 260*b* and the rack 245.

Further, the tapered surfaces 265 may be formed at the upper and lower portions of the lateral guide pad 261 and the toothed-part guide pads 262. The tapered surfaces 265 serve as oblique surfaces for smooth entry of the canister 110, and thereby can ensure that the rack 245 easily enters the space defined by the lateral guide pad 261 and the toothed-part guide pads 262.

As illustrated in FIG. 13, each of the tapered surfaces 265 may include a first tapered surface 265*a* that is obliquely formed at an entry which the rack 245 enters, and a second tapered surface 265*b* that is obliquely formed to extend from the first tapered surface 265*a* so as to have a smaller gradient than the first tapered surface 265*a*.

Thus, when the rack 245 enters the lower guide unit 260*b* or the lift unit 240, the rack 245 can stably smoothly enter the lower guide unit 260*b* or the lift unit 240.

In FIG. 13, the first tapered surface 265*a* is formed at a ¼ gradient, and the second tapered surface 265*b* is formed at a 1/10 gradient. However, without being limited thereto, the dimensions may be variously changed within a range within which the second tapered surface 265*b* is designed to have a smaller gradient than the first tapered surface 265*a*.

Figure 14:
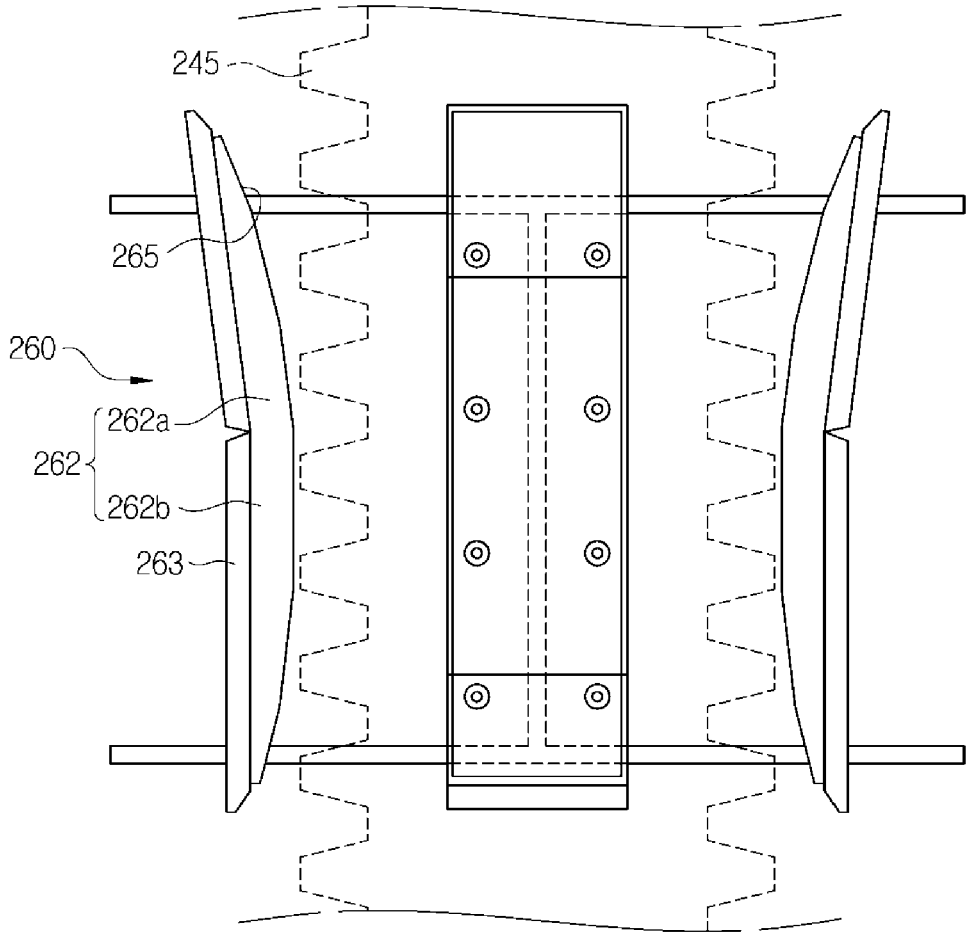
FIG. 14 is a perspective view illustrating a modification of the guide unit of the guide module included in the canister type thruster according to the second embodiment of the present invention.

FIG. 14 is a front view illustrating a modification of the guide unit 260 of the guide module included in the canister type thruster 200 according to the second embodiment of the present invention.

As illustrated in FIG. 14, each of the toothed-part guide pads 262 of the guide unit 260 may include an entry pad 262*a* having a tapered surface 265, and a guide pad 262*b* that is connected to the entry pad 262*a* in a curvilinear form.

As described above, the canister type thruster 200 according to the second embodiment of the present invention realizes the upward/downward movement and its guidance of the canister 110 on the same axis as the rack 245. Thereby, in comparison with the case in which the upward/downward movement and its guidance of the canister 110 are realized at a different position, it is possible to reduce manufacturing costs, improve work productivity, selectively use the thickness adjusting plate to minutely adjust the tolerance between the rack 245 and the guide unit 260, and form the tapered surfaces 265 at the upper and lower portions of the lateral guide pad 261 and the toothed-part guide pads 262 to smoothly guide the canister 110.

FIGS. 15 to 20 illustrate a canister type thruster 300 according to a third embodiment of the present invention.

Unless otherwise indicated or described by separate numerals or symbols, components of the canister type thruster 300 according to the third embodiment of the present invention are substantially the same as those of the canister type thruster 100 according to the first embodiment of the present invention, and so duplicate description thereof will be omitted.

Figure 15:
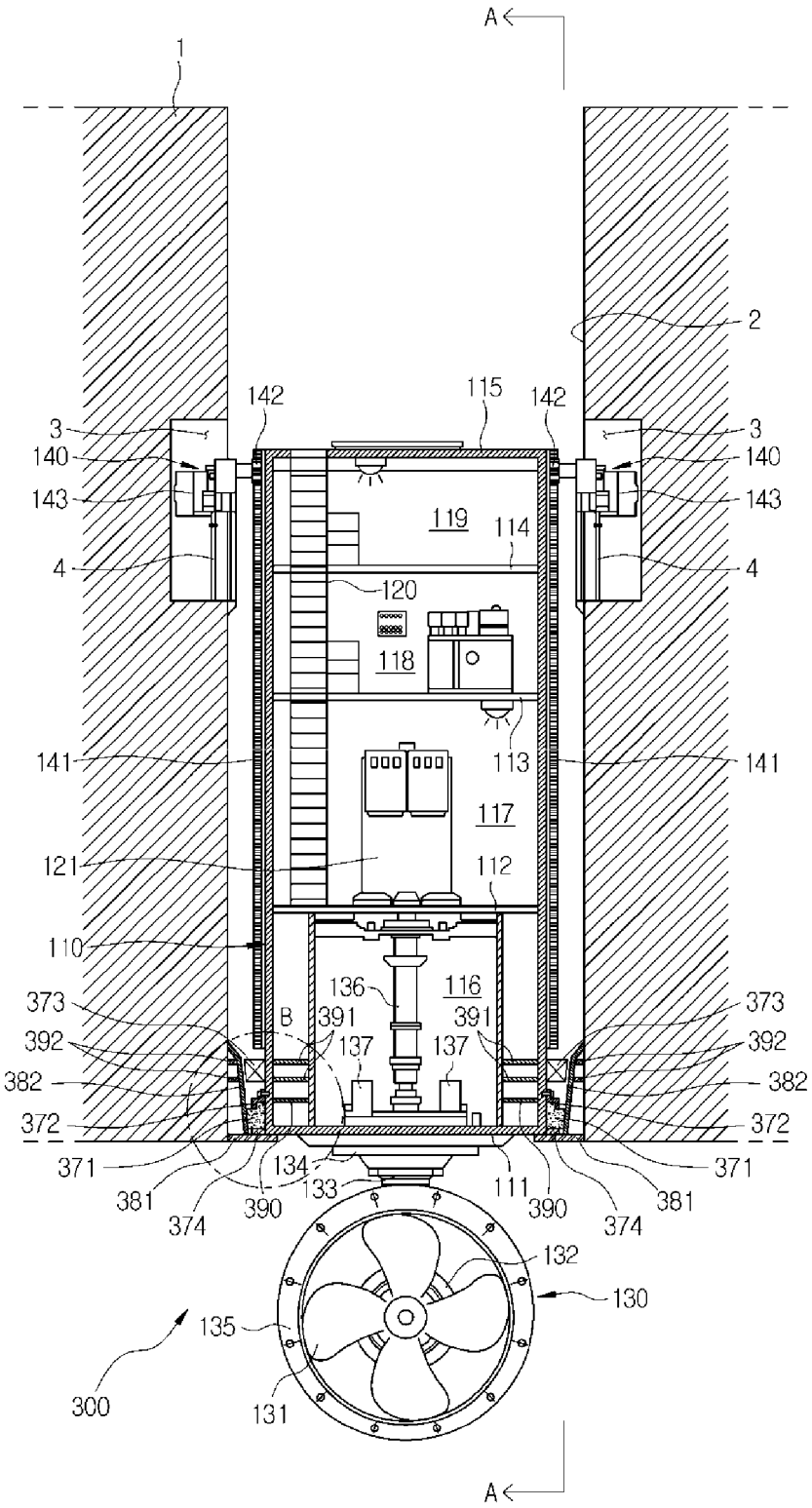
FIG. 15 is a sectional view illustrating a state in which a canister type thruster according to a third embodiment of the present invention is mounted in a hull.
Figure 16:
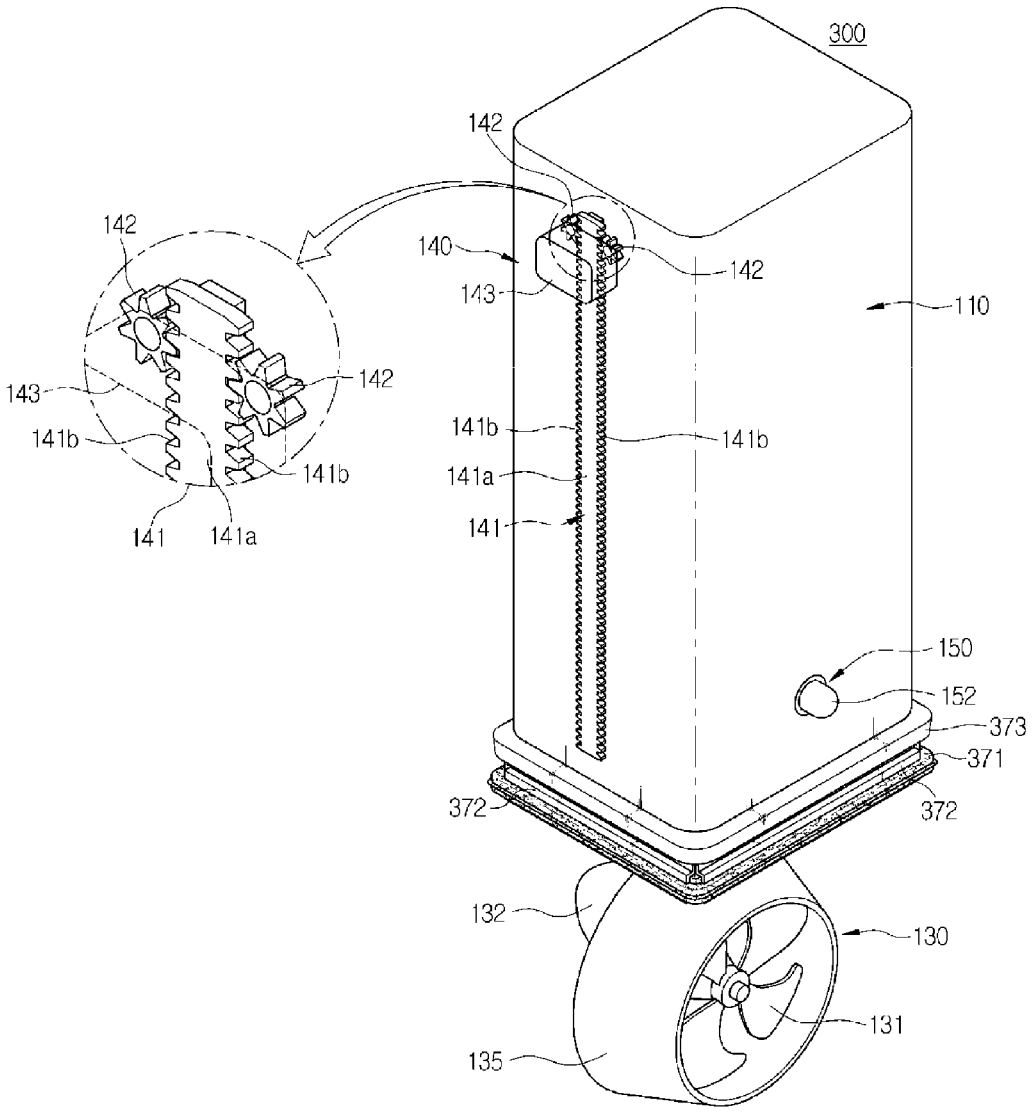
FIG. 16 is a perspective view illustrating the canister type thruster according to the third embodiment of the present invention.

FIG. 15 is a sectional view illustrating an internal configuration of the canister type thruster 300 according to the third embodiment of the present invention and a state in which the canister type thruster 300 is mounted in a hull. FIG. 16 is a perspective view illustrating the canister type thruster 300 according to the third embodiment of the present invention.

Referring to FIGS. 15 and 16, an inner surface of a trunk 2 may be provided with a canister seat 380 at a lower end thereof such that a canister 110 can be placed thereon. The canister seat 380 may include a support seat 381 that is in contact with a lower end face of the canister 110 to vertically support the canister 110, and a sealing seat 382 that is in contact with a sealing device 370 (to be described below) to form a waterproof structure. The support seat 381 may be formed at the lower end of the inner surface of the trunk so as to protrude inward from the trunk. As a result, the support seat 381 can vertically support the canister 110 while the lower end face of the canister 110 is in contact with the top of the support seat 381.

The sealing seat 382 may be provided in such a manner that one end thereof is coupled to the top of the support seat 381 and a cross section thereof is tapered inward toward the bottom of the trunk. That is, the sealing seat 382 may be formed between the inner surface of the trunk 2 and an outer surface of the canister 110 in a lifting direction such that a longitudinal section thereof is reduced toward the top of the trunk 2, i.e. that a lateral surface thereof is tapered. The sealing seat 382 may form a waterproof structure along with the sealing device 370 (to be described below) while being in contact with the sealing device 370.

A rack 141 moves up and down by means of an operation of a lift drive 143, and thereby a lift unit 140 can realize upward/downward movement of the canister 110. Thereby, it is possible to change a position of a propellant head 130 installed at a lower portion of the canister 110. That is, it is possible to convert a mode of the canister type thruster 300 into any one of an operation mode of locating the propellant head 130 below the bottom of the hull 1 to control the position of the hull 1 as in FIG. 17, a movement mode of pulling up the propellant head 130 into the trunk 2 to reduce resistance when the hull 1 moves as in FIG. 18, and a maintenance mode of pulling up the propellant head 130 to a maintenance space 6 at an upper portion of the trunk 2 for the purpose of maintenance of the propellant head 130 as in FIG. 19.

Figure 19:
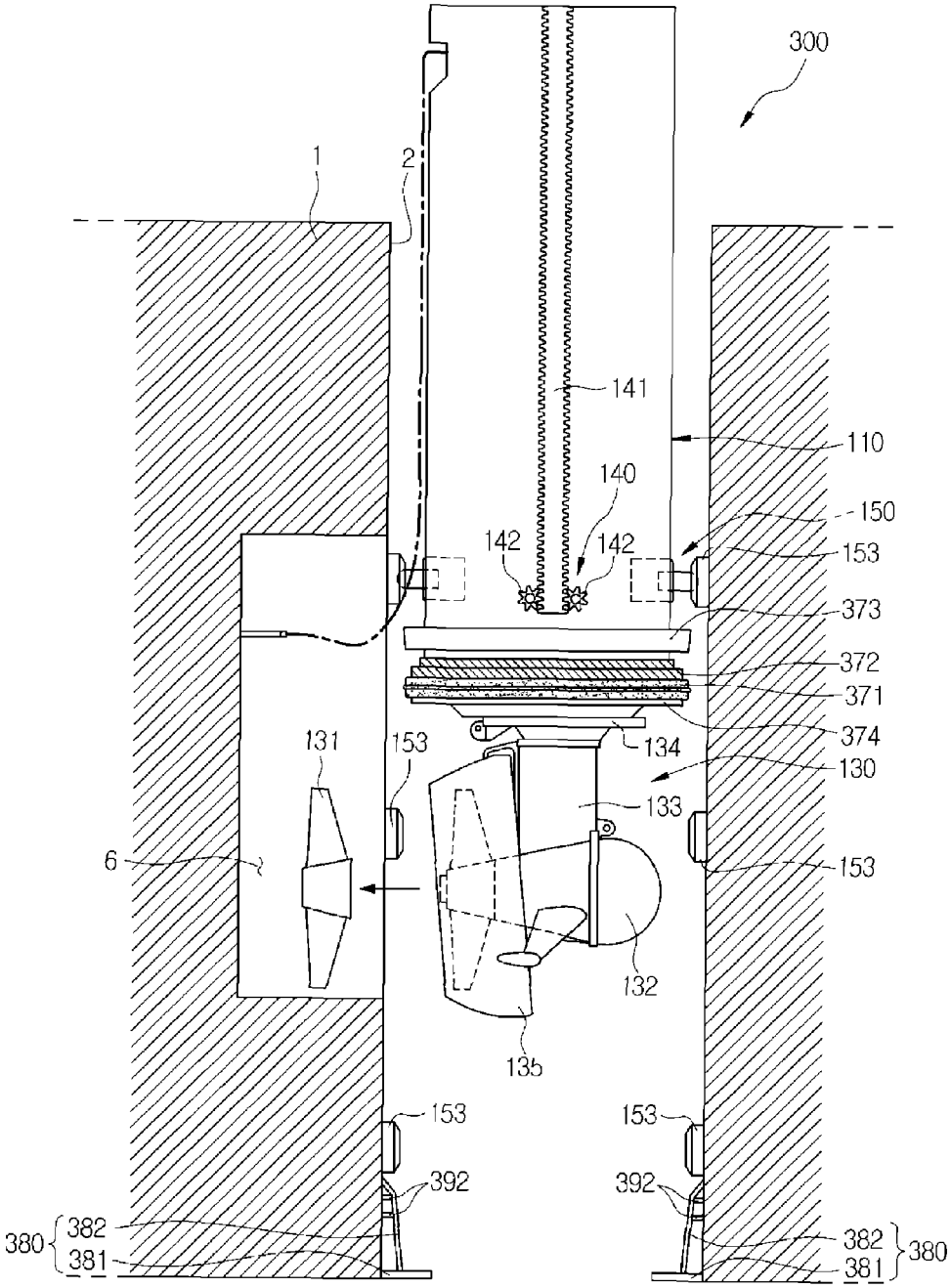

As illustrated in FIG. 19, the maintenance space 6 for the maintenance of the propellant head 130 may be provided in the inner surface of the trunk 2 which is at a height at which the propellant head 130 is located in the maintenance mode. The maintenance space 6 may have enough size to disassemble components of the propellant head 130 and then store the disassembled components in the maintenance space 6 or to enable a worker to approach the propellant head 130 to perform maintenance, and may be located above the seal level in a state in which the ship has been launched.

Figure 17:
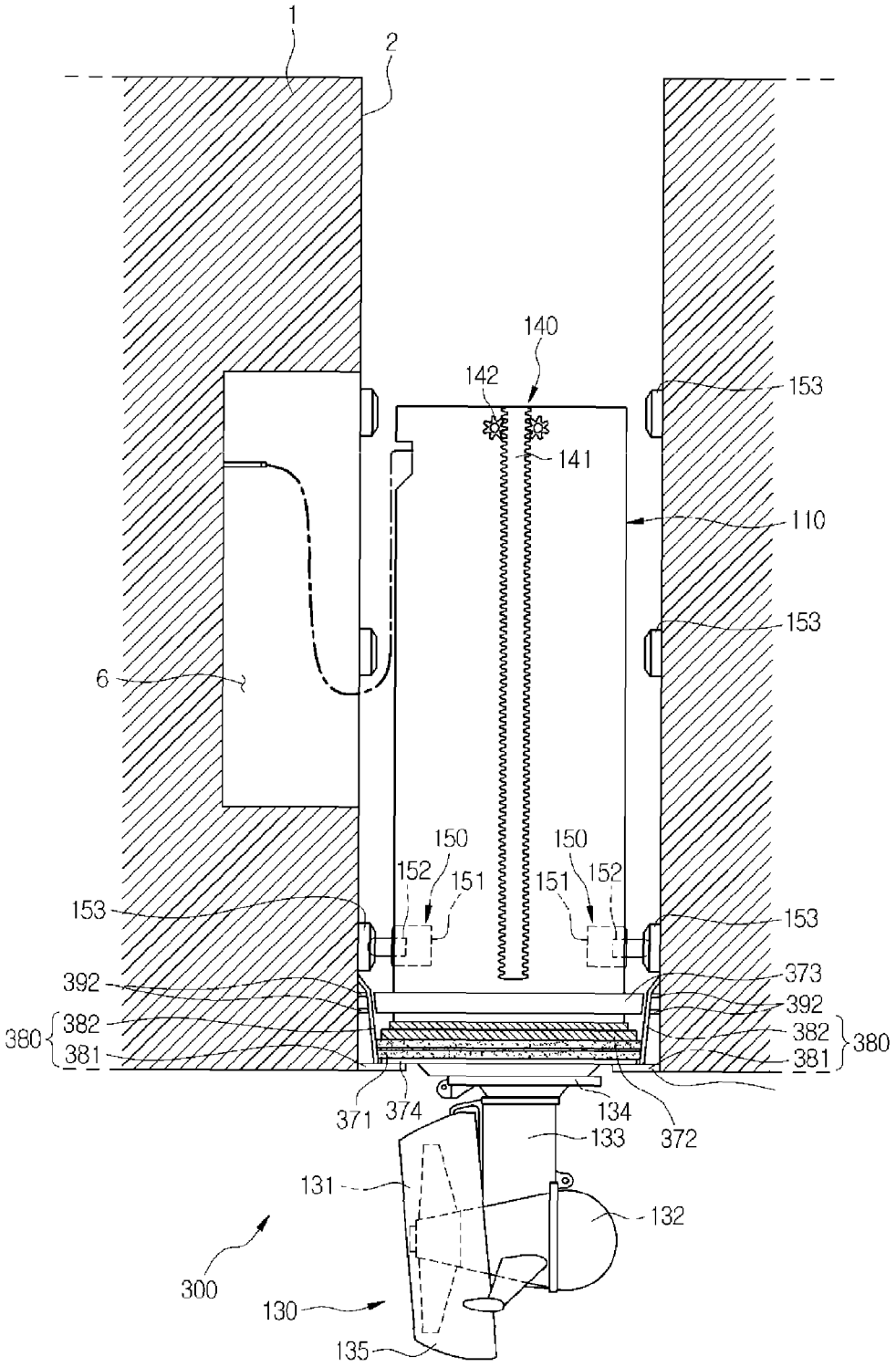
FIGS. 17 to 19 are sectional views taken along line A-A of FIG. 15, and illustrate states in which the canister type thruster according to the third embodiment of the present invention moves to respective positions for an operation mode, a movement mode, and a maintenance mode.
Figure 18:
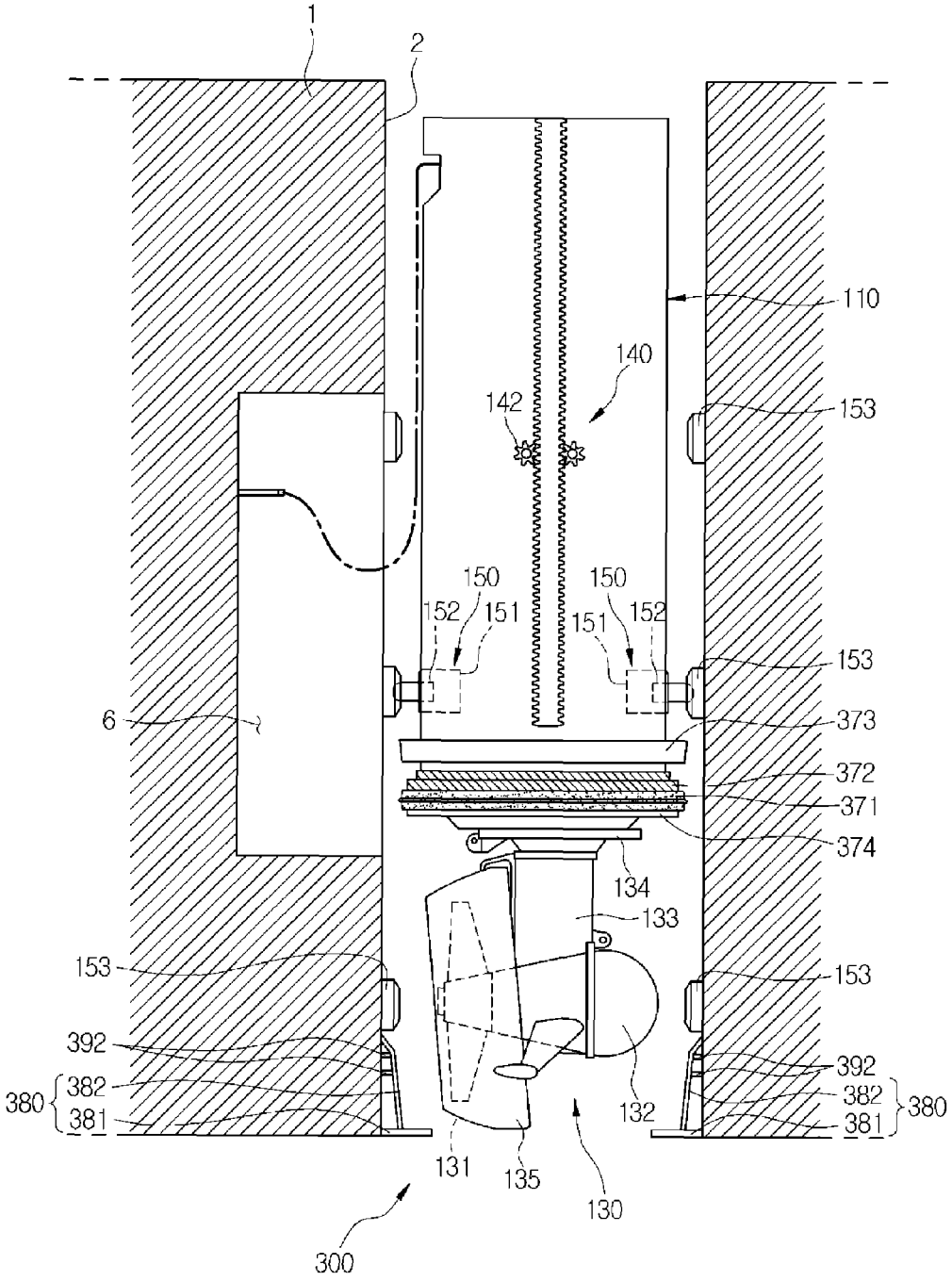

As illustrated in FIGS. 17 to 19, the canister type thruster 300 is provided with a plurality of restraints 150 that can restrain the canister 110 without arbitrary movement in a state in which the mode thereof is converted into the operation mode, the movement mode, or the maintenance mode.

In the case of the operation mode, the canister type thruster 300 includes the sealing device 370 forming the waterproof structure to prevent sea water from flowing into a space between the canister 110 and the trunk 2.

When the propellant head 130 is disposed below the bottom of the hull 1 in the operation mode, the canister 110 is placed on the support seat 381 of the canister seat 380. Since a position at which the lower end face of the canister 110 comes into contact with the support seat 381 is lower than the sea level, there is a danger of the sea water flowing into the space between the canister 110 and the trunk 2. When the sea water flows into the space between the canister 110 and the trunk 2, the lift unit 140 or the restraints 150 installed on the outer surface of the canister 110 are exposed to salt and corroded, which causes difficulty and danger of work done in the inner surface of the trunk 2. For this reason, there is a need to form the waterproof structure between the canister 110 and the canister seat 380 on which the canister 110 is placed to prevent inflow of the sea water.

Figure 20:
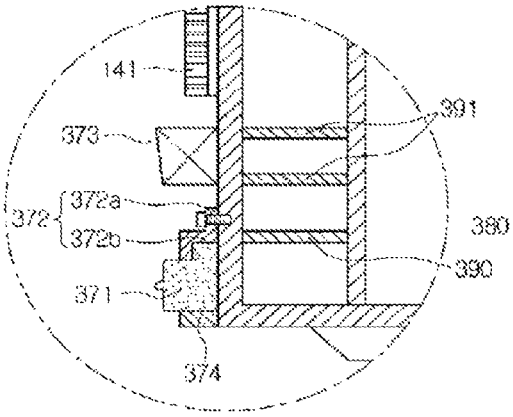
FIG. 20(*a*) is an enlarged sectional view illustrating a sealing device included in the canister type thruster according to the third embodiment of the present invention, and FIG. 20(*b*) is an enlarged sectional view illustrating a portion B of FIG. 15.
Figure 20:
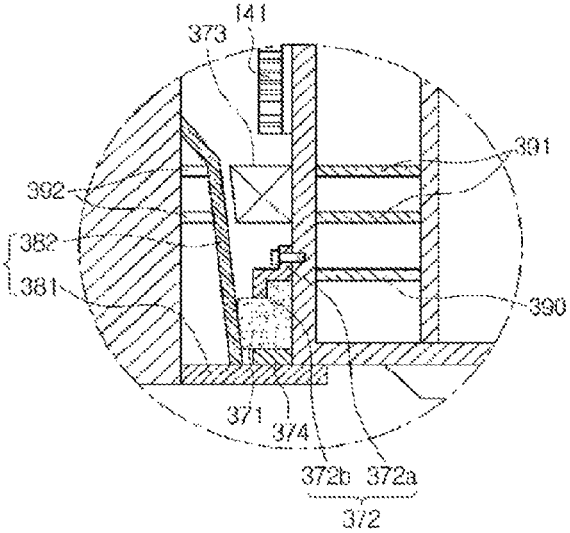

FIG. 20(*a*) is a sectional view illustrating the sealing device 370 included in the canister type thruster 300 according to the third embodiment of the present invention. FIG. 20(*b*) is an enlarged sectional view of a part B of FIG. 15 wherein the sealing device 370 and the canister seat 380 constituted in the canister type thruster 300 according to the third embodiment of the present invention are enlarged. Referring to FIGS. 20(*a*) and 20(*b*), the sealing device 370 of the canister type thruster 300 according to the third embodiment of the present invention may include a sealing member 371 that is in contact with the canister 110 on one surface thereof and the sealing seat 382 of the canister seat 380 on the other surface thereof in order to form the waterproof structure, a fixing bracket 372 that maintains the close contact of the sealing member 371 to the outer surface of the canister 110 so as to prevent the sealing member 371 from being separated from the canister 110, a sealing limiter 373 that is formed to protrude from the outer surface of the canister 110 above the fixing bracket 372 in order to prevent the sealing member 371 from being damaged by excessive compression against the sealing seat 382 when the canister 110 is vibrated in a horizontal direction by an external force such as waves, and a support protrusion 374 that is formed to protrude outward from a lower end of the outer surface of the canister 110 so as to support a lower surface of the sealing member 371.

The sealing member 371 may be formed of an elastically deformable member, one surface of which comes into close contact with the canister 110, the other surface of which comes into close contact with the sealing seat 382, and which can maintain a close contact force even if the canister 110 is vibrated or displaced in the horizontal direction by the external force. That is, even if the canister 110 relatively moves away from the sealing seat 382 due to the horizontal vibration or displacement, the compressed sealing member 371 is expanded and can maintain the close contact force even if a distance between the canister 110 and the sealing seat 382 is slightly increased. Preferably, the sealing member 371 may be formed of a synthetic rubber material having high durability against sea water.

The fixing bracket 372 may be provided such that the sealing member 371 maintains the close contact force with respect to the outer surface of the canister 110 and is prevented from being separated from the canister 110. The fixing bracket 372 may include a coupler 372*a* that is fixedly coupled with the outer surface of the canister 110 and a fixture 372*b* that fixedly supports a part of the sealing member 371 while surrounding the part of the sealing member 371. Since a lower surface of the sealing member 371 is supported by the support protrusion 374, the fixture 372*b* of the fixing bracket 372 partly surrounds upper and lateral surfaces of the sealing member 371, and thereby can be brought into close contact with and fixed to the outer surface of the canister 110.

Meanwhile, when the sealing member 371 is worn or damaged, the sealing member 371 should be replaced. Thus, the fixing bracket 372 fixing the sealing member 371 is provided to be able to be decoupled from and coupled to the canister 110. The coupler 372*a* of the fixing bracket 372 and the outer surface of the canister 110 may be coupled by bolting. The fixing bracket 372 may be installed to surround the entire outer surface of the sealing member 371. However, to facilitate installation and maintenance, a plurality of fixing brackets 372 having a predetermined length may be provided for the sealing member 371 at a plurality of portions.

The sealing limiter 373 may be provided above the fixing bracket 372 to prevent excessive compression of the sealing member 371. The sealing limiter 373 may be formed above the fixing bracket 372 so as to protrude outward from the outer surface of the canister 110, and be provided longer than a length which the fixing bracket 372 protrudes from the outer surface of the canister 110. When the propellant head 130 is in the operation mode, the canister 110 may be vibrated or displaced in horizontal and vertical directions by the external force such as waves. At this time, locked rods 152 enter locking members 153 to restrain the canister 110, and thus can prevent horizontal vibration or displacement of the canister 110. However, since the locked rods 152 protrude horizontally from the canister 110 to be locked on the trunk 2, horizontal vibration or displacement of the propellant head 130 may be transmitted to the canister 110 with no change.

When the canister 110 excessively leans to one direction of the inner surface of the trunk 2 due to the horizontal vibration or displacement, the sealing member 371 located at a side at which a distance between the canister 110 and the trunk 2 is relatively increased has a danger of losing a close contact force to resist the inflow of sea water. To prevent this, the sealing limiter 373 is provided above the sealing member 371 and the fixing bracket 372 in the vicinity of the sealing seat 382. Thereby, even if the canister 110 excessively leans to one direction, the sealing limiter 373 comes into contact with the sealing seat 382 to prevent the canister 110 from being excessively vibrated or displaced in the horizontal direction and simultaneously to prevent excessive compression of the sealing member 371 located at one side of the canister 110. Thereby, it is possible to reduce a danger of damaging the sealing member 371 and increase a service life of the sealing member 371. As the sealing seat 382 is tapered, a contact surface of the sealing limiter 373 which comes into contact with the sealing seat 382 may be tapered. The contact surfaces of the sealing limiter 373 and the sealing seat 382 are formed at the same inclination, and thereby are increased in area. Thus, it is possible to relieve an impact which the sealing limiter 373 applies to the sealing seat 382 while coming into contact with the sealing seat 382.

The support protrusion 374 formed to protrude outward from the canister to support the lower surface of the sealing member 371 may be provided at the lower end of the outer surface of the canister. The upper and lateral surfaces of the sealing member 371 are fixed and supported by the fixture 372*b* of the fixing bracket 372, and the lower surface of the sealing member 371 is fixed and supported by the support protrusion 374. Meanwhile, when the canister 110 is to be completely decoupled from the trunk 2 for the maintenance of the canister 110, the support protrusion 374 may collide with the surrounding members such as the lift units 140 or the guide units guiding upward/downward movement of the canister 110 because the support protrusion 374 is formed to protrude outward from the outer surface of the canister 110. To reduce this possibility and increase efficiency of work, the support protrusion 374 may be removably formed on the outer surface of the canister 110.

A plurality of reinforced plates 390 and 391 may be provided on an inner surface of the canister 110 which corresponds to positions at which the fixing bracket 372 and the sealing limiter 373 are installed. Since the canister 110 is a giant structure, even if slight vibration or displacement occurs in the horizontal direction, a great impact may occur at the canister 110 or the arrangement provided inside the canister 110. Therefore, to prevent the outer surface of the canister 110 from being deformed under this impact and secure a bearing force, the plurality of reinforced plates 390 and 391 may be provided on the inner surface of the canister 110 which corresponds to the positions at which the fixing bracket 372 and the sealing limiter 373 are installed. One ends of the reinforced plates 390 and 391 are in contact with the inner surface of the canister 110, and the other ends are supported by a partition (not shown) inside the canister 110. Therefore, with respect to stress occurring when the sealing member 371 is compressed or when the sealing limiter 373 comes into contact with the sealing seat 382, the bearing force for the outer surface of the canister 110 can be secured, and the deformation of the canister 110 can be prevented.

A plurality of reinforced plates 392 may be provided on a rear surface of the sealing seat 382 which corresponds to a position at which the sealing seat 382 is brought into contact with the sealing limiter 373. When the sealing seat 382 is brought into contact with the sealing limiter 373 by horizontal vibration or displacement, a great impact may be applied to the sealing seat 382. In this case, to prevent damage to the sealing seat 382, there is a need to secure a bearing force of the sealing seat 382. Therefore, the plurality of reinforced plates 392, one ends of which are supported on the rear surface of the sealing seat 382 which corresponds to a height at which the sealing seat 382 is brought into contact with the sealing limiter 373 and the other ends of which are supported on the inner surface of the trunk 2 may be formed.

When the sealing member is disposed on the lower surface of the canister as in a typical canister type thruster, a degree of compression of the sealing member cannot be adjusted, a possibility of the sealing member leaving the canister is high, and it is very difficult to realize a stable waterproof structure because the canister should be accurately maintained at a level when placed on the canister seat. However, in the canister type thruster 300 according to the third embodiment of the present invention, the sealing device 370 is provided on the lower end of the outer surface of the canister 110, and the canister seat 380 is provided with the tapered sealing seat 382. Thereby, the waterproof structure based on the sealing member 371 can be easily formed with respect to the vertical and horizontal vibrations of the canister 110. Further, the sealing limiter 373 is provided to prevent the excessive compression of the sealing member 371. Thereby, it is possible to prevent the damage to the sealing limiter 373 and increase the service life of the sealing member 371, and to prevent excessive vibration of the canister 110. The fixing bracket 372 fixing the sealing member 371 as well as the support protrusion 374 is removably provided. Thus, when the canister 110 is to be completely decoupled from the trunk 2 or when the sealing device 370 is to be disassembled by a need for another task, the sealing device 370 can be easily decoupled and installed again, and thus the efficiency of work can be increased. In addition, the reinforced plates 390 and 391 are provided on the inner surface of the canister 110, and the reinforced plates 392 are provided on the rear surface of the sealing seat 382. Thereby, the stable waterproof structure can be formed under reliable conditions.

Figure 21:
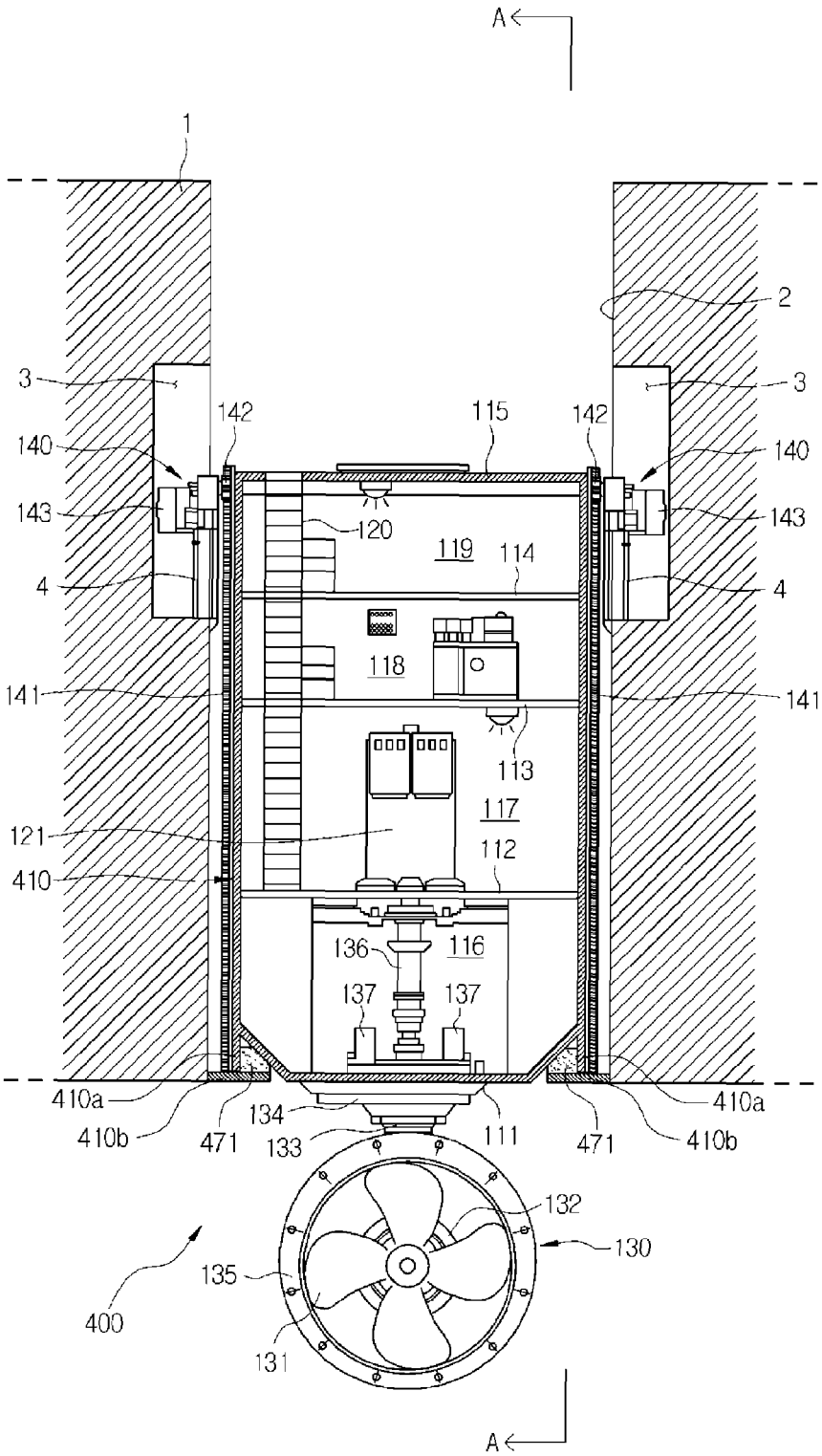
FIG. 21 is a sectional view illustrating a state in which a canister type thruster according to a fourth embodiment of the present invention is mounted in a hull.
Figure 22:
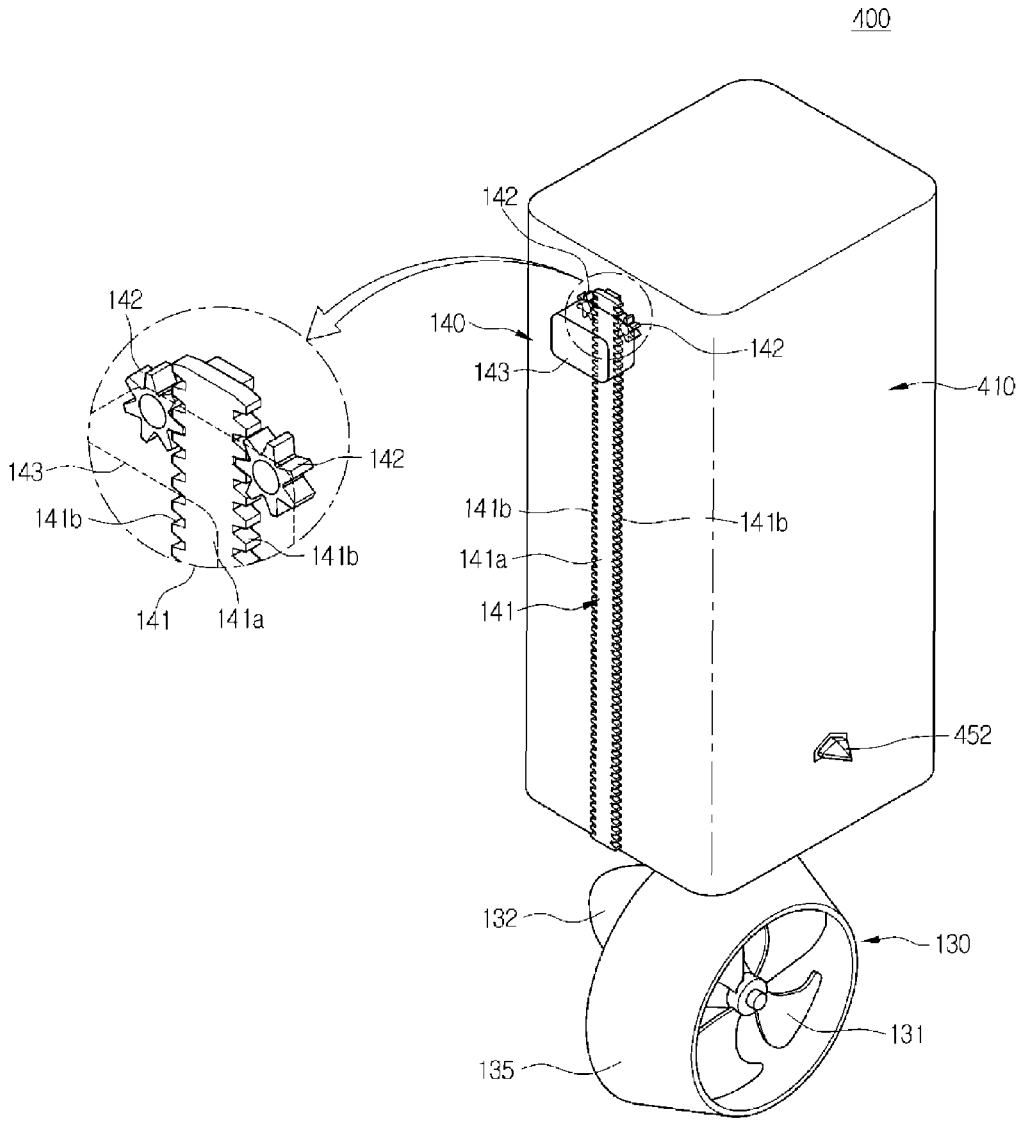
FIG. 22 is a perspective view illustrating a canister type thruster according to a fourth embodiment of the present invention.

FIGS. 21 to 30 are views illustrating a canister type thruster 400 according to a fourth embodiment of the present invention. FIG. 21 is a sectional view illustrating a state in which the canister type thruster 400 according to the fourth embodiment of the present invention is mounted in a hull, and FIG. 22 is a perspective view illustrating the canister type thruster 400 according to the fourth embodiment of the present invention.

Unless otherwise indicated or described by separate numerals or symbols, components of the canister type thruster 400 according to the fourth embodiment of the present invention are substantially the same as those of the canister type thruster 100 according to the first embodiment of the present invention, and so duplicate description thereof will be omitted.

Referring to FIGS. 21 and 22, a hull 1 of a ship (or a floating structure) is provided with a trunk 2 passing through it in an upward/downward direction. The canister type thruster 400 according to the fourth embodiment of the present invention includes a canister 410 that is liftably installed in the trunk 2, a propellant head 130 that is installed at a lower portion of the canister 410, at least one lift unit 140 that moves the canister 410 up and down, at least one guide module (not shown) that guides upward/downward movement of the canister 410, a sealing device 460 that forms a waterproof structure between the canister 410 and a canister seat 410*b* on which the canister 410 is placed, and restraints 450 that restrain the canister 410 in the trunk 2 without arbitrary movement.

A lower end of an inner surface of the trunk 2 may be provided with the canister seat 410*b* on which the canister 410 can be placed. The sealing device 460 to be described below is provided between the canister seat 410*b* and the canister 410, and can form the waterproof structure between the canister seat 410*b* and the canister 410.

As illustrated in FIGS. 21 and 22, when being in an operation mode, the canister type thruster 400 may include the sealing device 460 forming the waterproof structure between the canister seat 410*b* and the canister 410. The sealing device 460 may include a sealing member 471 that is formed of an elastically deformable member to form the waterproof structure at an edge of a lower surface of the canister 410, and a fixing member that fixedly supports the sealing member 471 to prevent the sealing member 471 from being separated from the lower surface of the canister 410. A skirt 410*a* coming into contact with the canister seat 410*b* is provided around the lower end of the canister 410, and the sealing member 471 is fixedly supported inside the skirt 410*a* by the fixing member. Thereby, the waterproof structure can be formed between the canister 410 and the canister seat 410*b*.

Figure 23:
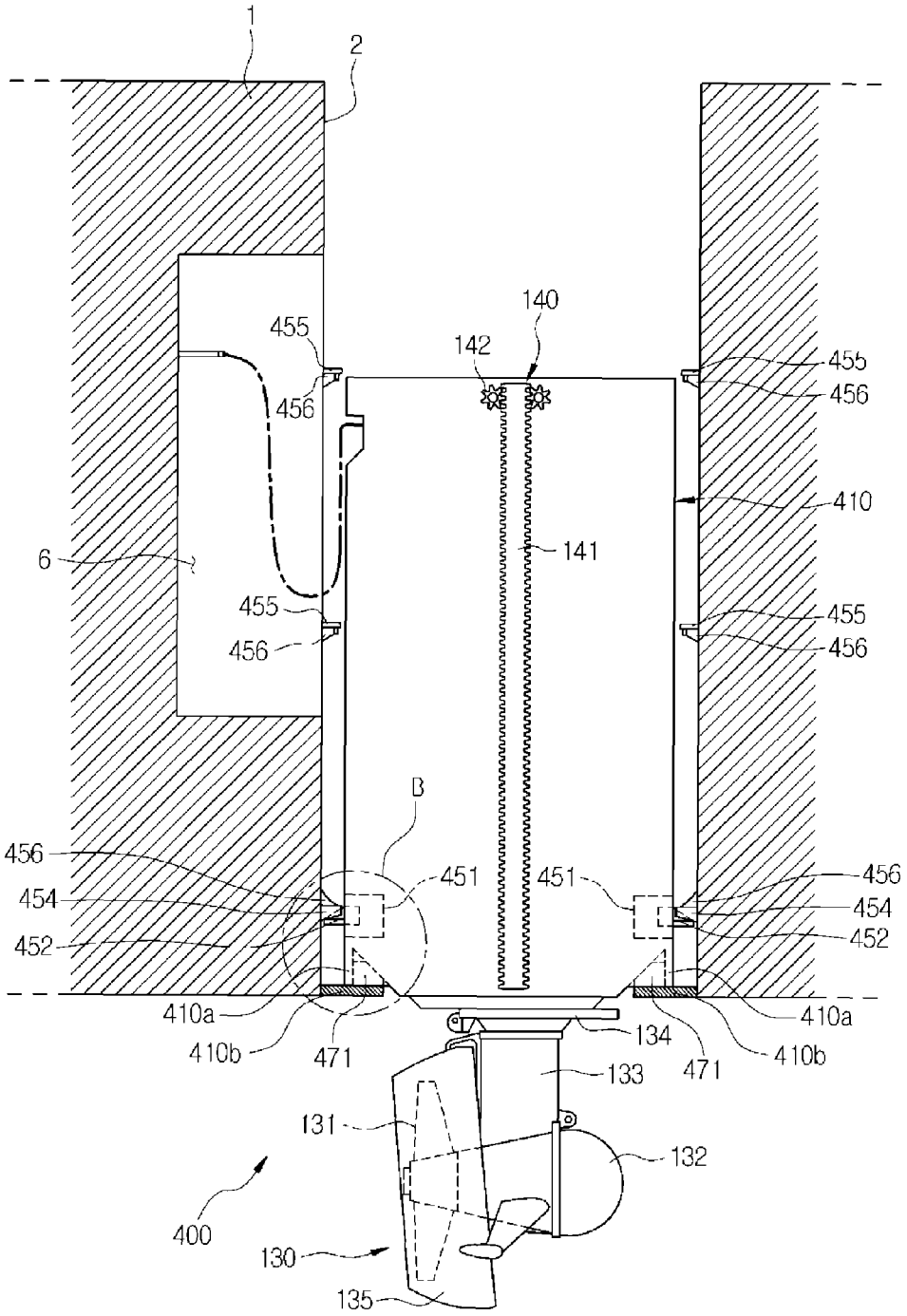
FIGS. 23 to 25 are sectional views taken along line A-A of FIG. 21, and illustrate states in which the canister type thruster according to the fourth embodiment of the present invention moves to respective positions for an operation mode, a movement mode, and a maintenance mode.
Figure 24:
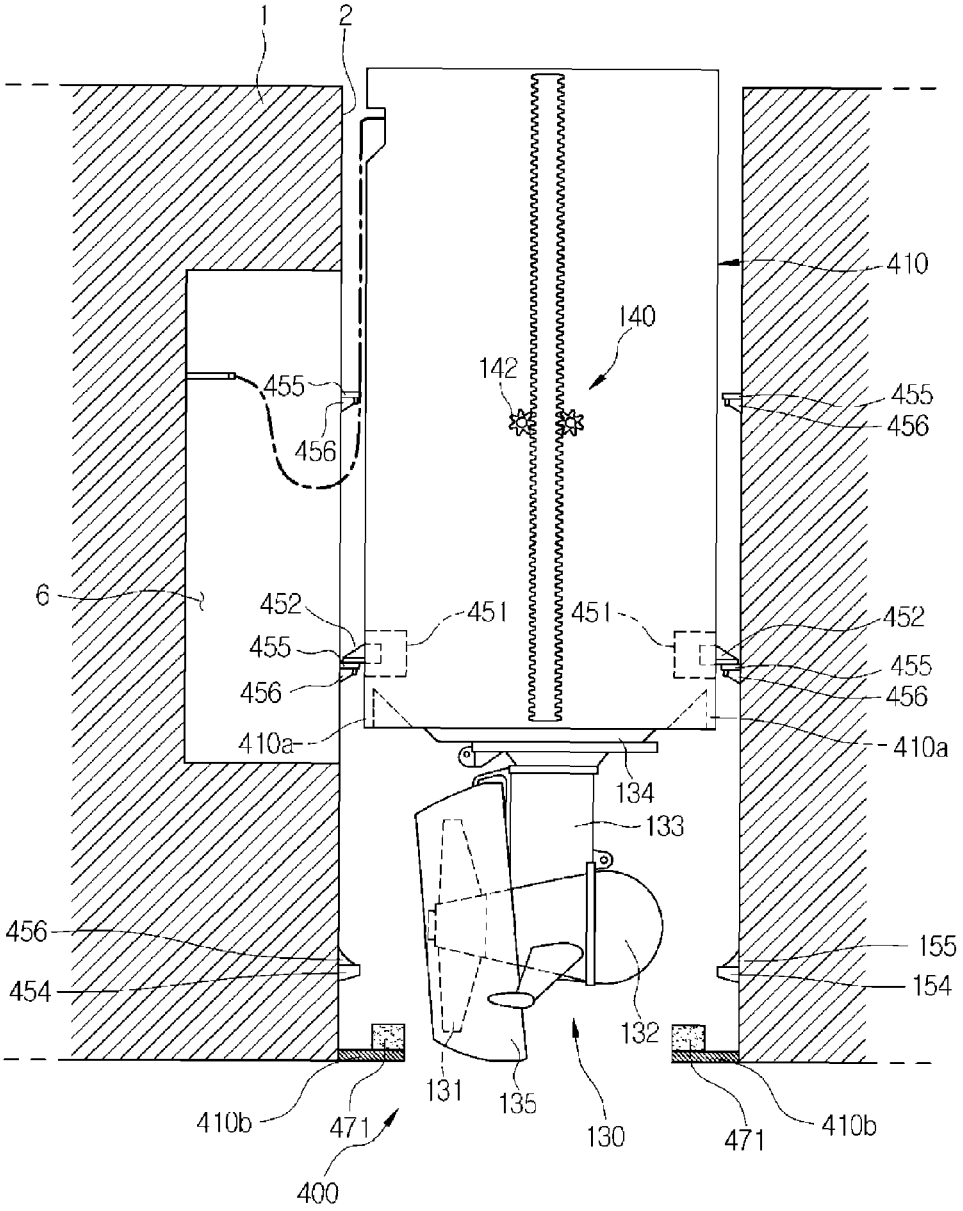
Figure 25:
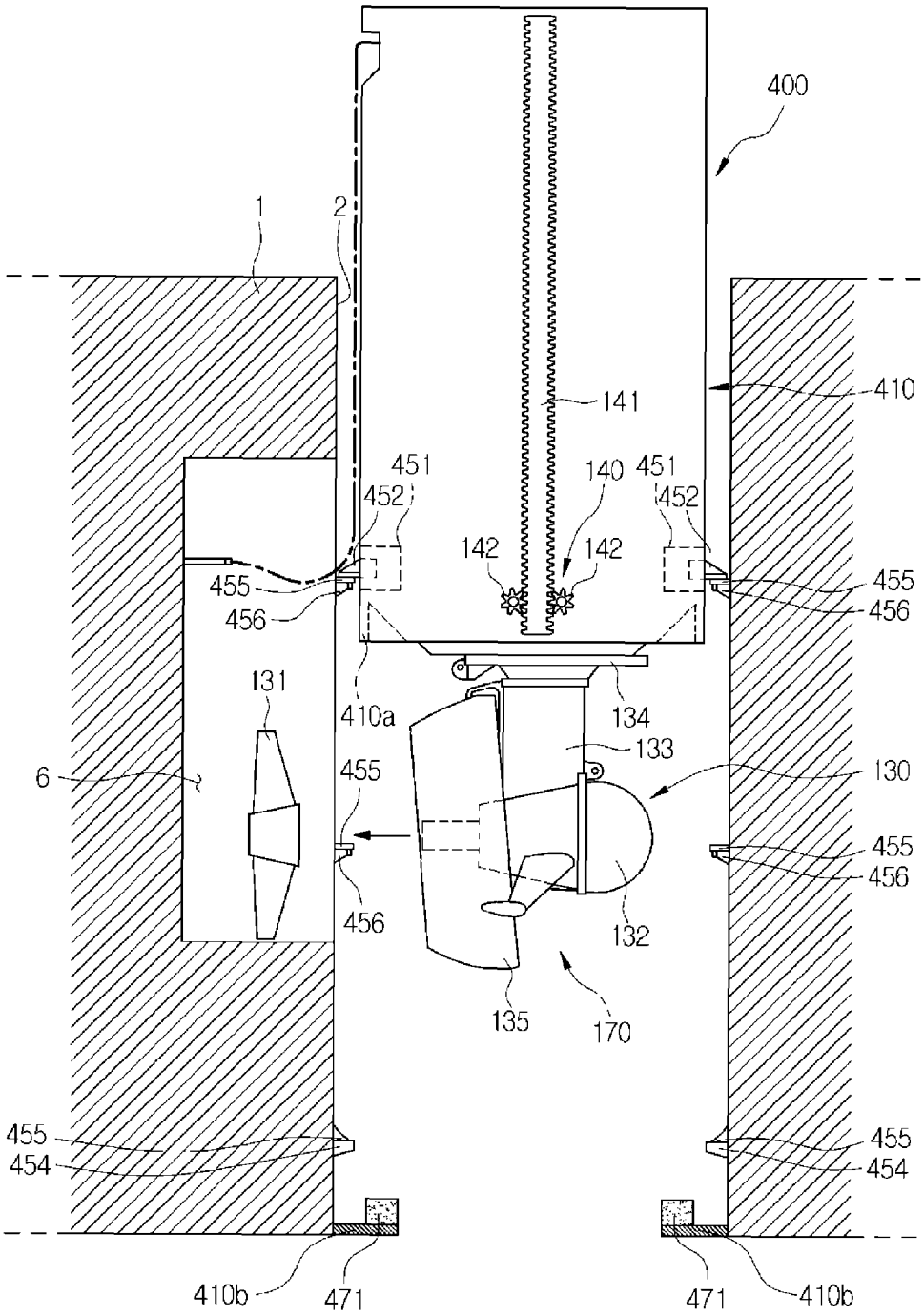

As illustrated in FIGS. 23 to 25, the canister type thruster 400 is provided with the plurality of restraints 450 that can restrain the canister 410 without arbitrary movement in a state in which a mode thereof is converted into an operation mode, a movement mode, or a maintenance mode.

Each of the restraints 450 may include a locked rod 452 that horizontally protrudes outward from the canister 410 to be locked, and a locking member 453 that is provided at a position corresponding to that of the locked rod 452 such that the locked rod 452 can be fitted and locked. The plurality of locking members 453 may be provided at the respective positions corresponding to the plurality of locked rods 452 such that the locked rods 452 can be locked in the state in which the mode of the canister type thruster 400 is converted into the operation mode, the movement mode, or the maintenance mode.

The plurality of locking members 453 may include a first locking member 454 having a locking recess 454*a* into which the locked rod 452 is fitted when the canister type thruster 400 is in the operation mode in which it is located below the hull 1, and a second locking member 455 on which the locked rod 452 is put when the canister type thruster 400 is in the movement mode in which it is pulled up into the trunk 2 to reduce resistance when the hull 1 moves or when the canister type thruster 400 is in the maintenance mode in which it is pulled up to a height of the maintenance space 6.

Figure 26:
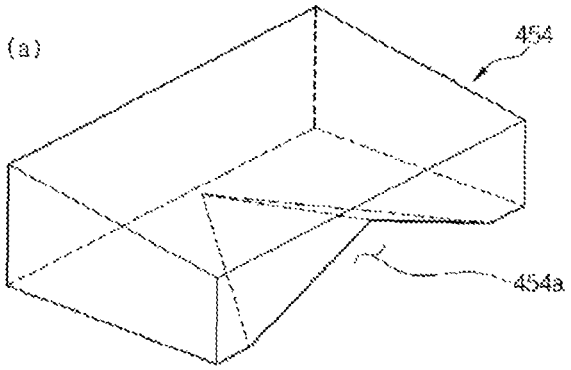
FIG. 26 illustrates a first locking member of a restrainer included in the canister type thruster according to the fourth embodiment of the present invention, wherein FIG. 26(*a*) is a perspective view of the first locking member, FIG. 26(*b*) is a sectional view of the first locking member, and FIG. 26(*c*) is a perspective view illustrating a state in which support ribs are installed on the first locking member.
Figure 26:
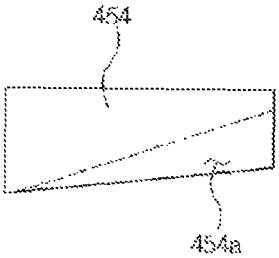
Figure 26:
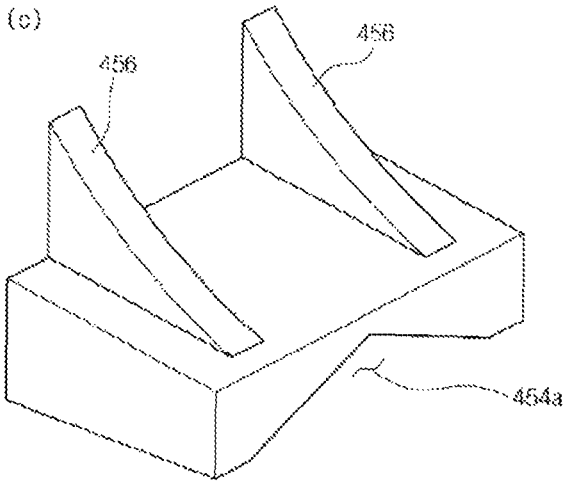

FIG. 26 is a view illustrating the first locking member 454 according to the fourth embodiment of the present invention wherein FIG. 26(*a*) is a perspective view and FIG. 26(*b*) is a sectional view. Referring to FIG. 26, the first locking member 454 may have an open lower surface such that an upper surface of the locking recess 454*a* is provided as an inclined plane so as to be inclined downward with the approach to the inner surface of the trunk 2. That is, the locking recess 454*a* has a triangular cross section, and a central axis thereof may be directed to a lower portion of the hull 1 with the approach to the inner surface of the trunk 2.

FIG. 26(*c*) is a perspective view illustrating a state in which support ribs 456 are provided on an upper surface of the first locking member 454. Since the lower surface of the locking recess 454*a* is inclined downward with the approach to the inner surface of the trunk 2, as a length by which the locked rod 452 is fitted into the locking recess 454*a* increases, the first locking member 454 is subjected to greater stress to an upper side of the hull 1. Therefore, to secure a bearing force of the first locking member 454 under this stress, the support ribs 456 may be provided between the upper surface of the first locking member 454 and the inner surface of the trunk 2.

Figure 27A:
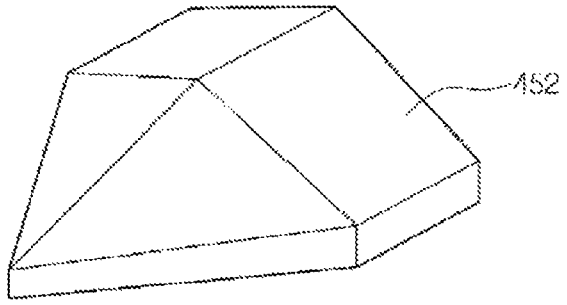
FIG. 27 illustrates a locked rod of the restrainer included in the canister type thruster according to the fourth embodiment of the present invention, wherein FIG. 27(*a*) is a perspective view of the locked rod, and FIG. 27(*b*) is a sectional view of the locked rod.
Figure 27:
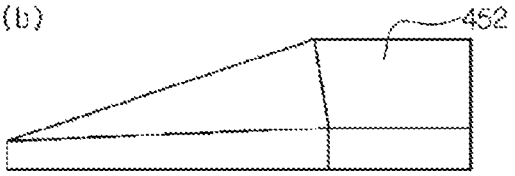

FIG. 27 is a view illustrating the locked rod 452 that horizontally protrudes outward from the canister 410 wherein FIG. 27(*a*) is a perspective view and FIG. 27(*b*) is a sectional view. Referring to FIG. 27, the locked rod 452 may be provided to have an inclined plane in correspondence to the shape of the locking recess 454*a* of the first locking member 454 such that an upper surface of the locked rod 452 is inclined upward with the approach to the outer surface of the canister 410. That is, since the upper surface of the locked rod 452 is inclined downward with the approach to the inner surface of the trunk 2, as a length by which the locked rod 452 is fitted into the locking recess 454*a* increases, the canister 410 in which the locked rod 452 is installed is subjected to a strong force in a downward direction of the hull 1, and the trunk 2 on which the first locking member 454 is installed is subjected to a strong force in an upward direction of the hull 1. Thereby, the canister 410 can be stably restrained in the trunk 2. A driver 451 implemented as a motor or a hydraulic cylinder to generate power by which the locked rod 452 is forced to protrude outward from the canister 410 may be installed in the canister 410.

As illustrated in FIGS. 26 and 27, the first locking member 454 is provided to have the open lower surface. Thereby, when the locked rod 452 is fitted into the locking recess 454*a* of the first locking member 454, the opposite lateral faces of the locking recess 454*a* are restrained in contact with the locked rod 452, and thus the canister 410 can be free from vertical vibration as well as horizontal vibration and rotation in the trunk 2. That is, the locked rod 452 comes into contact with the lower surface of the locking recess 454*a* and the movement thereof is restrained, and thereby the vertical vibration of the canister 410 can be prevented. Simultaneously, the locked rod 452 comes into contact with the opposite lateral surfaces of the locking recess 454*a* and the movement thereof is restrained, and thereby the horizontal vibration and rotation of the canister 410 can be prevented.

Figure 28A:
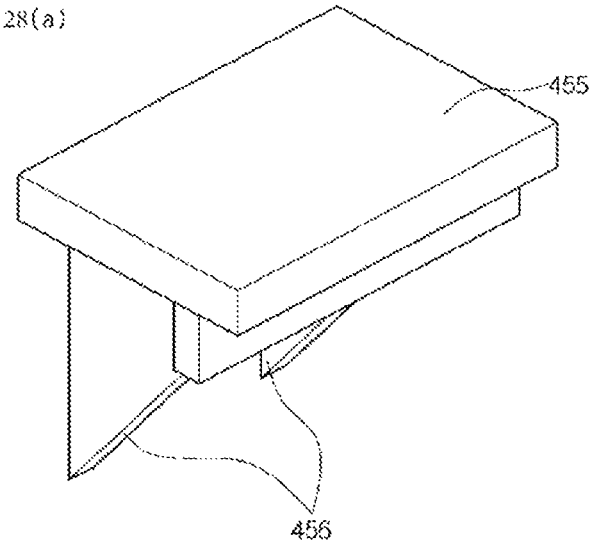
FIG. 28(*a*) is a perspective view illustrating a state in which support ribs are installed on a second locking member of the restrainer included in the canister type thruster according to the fourth embodiment of the present invention, and FIG. 28(*b*) is a perspective view illustrating a state in which the locked rod is put on the second locking member.
Figure 28B:
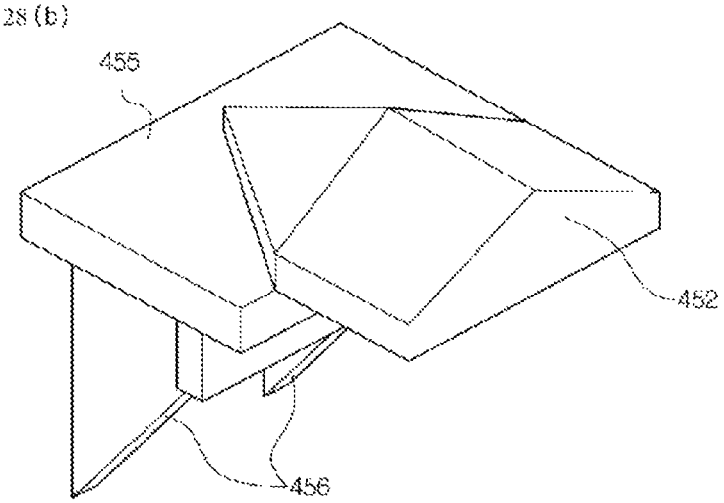

FIG. 28(*a*) is a perspective view illustrating the second locking member 455 which the locked rod 452 approaches when the canister 410 is in the operation or maintenance mode. FIG. 28(*b*) is a perspective view illustrating a state in which the locked rod 452 is placed on the second locking member 455. Referring to FIG. 28, the second locking member 455 may be provided at a position at which the locked rod 452 moves to be locked when the canister type thruster 400 is in the movement mode in which the canister 410 moves upward for the moving of the hull 1 or when the canister type thruster 400 is in the maintenance mode. The second locking member 455 is formed to horizontally protrude from the inner surface of the trunk 2, and is provided such that the locked rod 452 is put on the upper surface thereof. Therefore, the upper surface of the second locking member 455 may be flatly provided in a horizontal direction, and in correspondence to this, a lower surface of the locked rod 452 may be flatly provided in a horizontal direction. The locked rod 452 is fitted into the locking recess 454*a* of the first locking member 454 in the operation mode, and is put on the upper surface of the second locking member 455 in the movement mode, and thereby the canister 410 can be supported in the trunk 2. The support ribs 456 may be additionally installed between the lower surface of the second locking member 455 and the inner surface of the trunk 2 to secure a bearing force of the second locking member 455. Unlike a conventional configuration in which the locked rod is completely fitted into the insertion recess of the inner surface of the trunk, the locked rod 452 is put on the second locking member 455 to be able to support the canister 410. Thus, a structure is simplified, and the degree of difficulty of work and the work time can be remarkably reduced when the position of the second locking member 455 is selected on the inner surface of the trunk, which produces an effect of improving productivity. In the present embodiment, the case in which the second locking member 455 is provided at the height at which the locked rod 452 protrudes in the movement and maintenance modes has been described. However, according to a need for work, the second locking member 455 is additionally installed on the inner surface of the trunk 2 or is installed only in the case of any one of the movement and maintenance modes so as to be able to restrain the canister 410.

Figure 29:
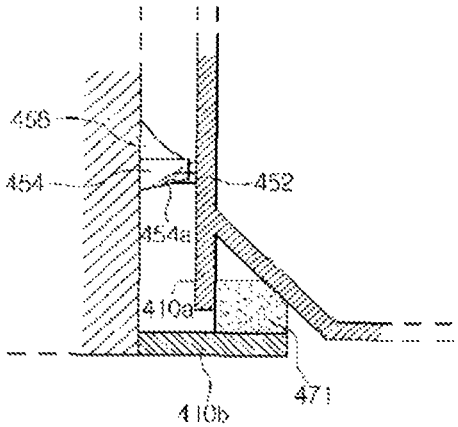
FIG. 29 is an enlarged sectional view illustrating a portion B of FIG. 23, and is a sectional view illustrating a degree to which a sealing member of a sealing device is compressed step by step according to an extent to which the locked rod of the restrainer included in the canister type thruster according to the fourth embodiment of the present invention enters the first locking member.
Figure 29:
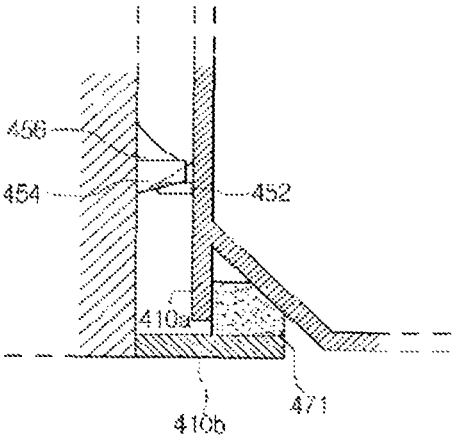
Figure 29:
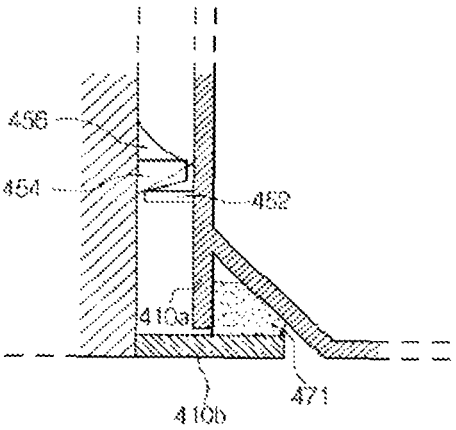

FIG. 29 is an enlarged sectional view illustrating a portion B of FIG. 23 wherein FIGS. 29(*a*) to 29(*c*) illustrate a relation between how much the locked rod is fitted into the locking recess 454*a* of the first locking member 454 and how much the sealing member 471 of the sealing device 460 is compressed. As illustrated in FIG. 29(*a*), when the canister type thruster 400 is in the operation mode, the locked rod 452 begins to enter the locking recess 454*a* of the first locking member 454 from the outer surface of the canister 410 in order to restrain the canister 410 in the trunk 2. Simultaneously, the sealing member 471 on the lower surface of the canister 410 begins to be pressed against the canister seat 410*b* while being in contact with the canister seat 410*b*.

When an close contact force of the sealing member 471 is deficient in forming the waterproof structure or when a part of the sealing member 471 is worn by repetitive use, as illustrated in FIG. 29(*b*), the locked rod 452 is forced to additionally protrude from the canister 410, and a length by which the locked rod 452 is fitted into the locking recess 454*a* of the first locking member 454 can be increased. An upper surface of the locking recess 454*a* and an upper surface of the locked rod 452 coming into contact with it are provided as inclined planes so as to be inclined downward toward the inner surface of the trunk 2. For this reason, as the length by which the locked rod 452 is fitted into the locking recess 454*a* increases, the canister 410 is pressed toward the lower side of the hull 1. Thereby, an interval between the canister 410 and the canister seat 410*b* is gradually reduced, and the sealing member 471 is further compressed in contact with the canister seat 410*b* to be able to increase the close contact force. Since only the lower surface of the locking recess 454*a* of the first locking member 454 is open, the canister 410 can be stably fixed in the trunk 2 in the vertical direction as well as in the horizontal direction.

FIG. 29(*c*) illustrates a state in which the locked rod 452 is completely fitted into the locking recess 454*a* of the first locking member 454, and particularly in which the close contact force between the sealing member 471 and the canister seat 410*b* is maximized.

When a locking pin having, for instance, a circular sectional shape as in the restraint of the typical canister type thruster is configured to be fitted into a coupler provided for the inner surface of the trunk, the canister can be supported in the trunk only when the locking pin is completely fitted into the coupler. However, this configuration can prevent the vertical fluctuation (heaving) of the canister, but it is vulnerable to the horizontal vibration or rotation of the canister. That is, since this configuration is vulnerable to the vibration of the canister in the same direction as a direction in which the locking pin protrudes, the locking pin and the coupler should be installed at numerous positions of the canister and the trunk, which is troublesome. Further, the restraint of the typical canister type thruster has a problem in that, since the positions of the locking pin and the coupler are accurately matched with each other and an entry angle of the locking pin and a central axis of the coupler are also accurately matched with each other, excessive precision is required for installing work, which reduces the efficiency of work. In addition, since the degree of compression of the sealing member provided at the lower portion of the canister cannot be adjusted, the sealing member is excessively compressed more than needed, and the service life of the sealing member is reduced. When only a part of the sealing member is worn, there is no method of increasing the close contact force of the sealing member. Thus, the sealing member should be replaced with a new one, which generates a problem in which maintenance expenses and time are increased.

In contrast, in the canister type thruster 400 according to the fourth embodiment of the present invention, the lower surface of the locking recess 454*a* of the first locking member 454 into which the locked rod of the restraint 450 is fitted is open, and the locked rod 452 is put on the upper surface of the second locking member 455 to restrain the canister 410. Thus, the structure of the restraint is simplified, and precise position selecting work is not required in the process of installing the locking member 453. As a result, the efficiency of work can be increased, and the productivity can be improved.

Further, the lower surface of the first locking member 454 is open, and the upper surface of the locking recess 454*a* of the first locking member 454 and the upper surface of the locked rod 452 are provided as the inclined planes to be inclined downward with the approach to the inner surface of the trunk 2. When entering the locking recess 454*a*, the locked rod 452 comes into contact with the upper surfaces of the locking recess 454*a*, and its movement is restrained. Thereby, it is possible to effectively prevent the vertical vibration and the horizontal vibration and rotation of the canister 410 and to stably restrain the canister 410 in the trunk 2.

In addition, as the upper surface of the locking recess 454*a* of the first locking member 454 and the upper surface of the locked rod 452 are provided as the inclined planes to be inclined downward with the approach to the inner surface of the trunk 2, the degree of compression of the sealing member 471 provided at the lower portion of the canister 410 can be adjusted according to the length by which the locked rod 452 enters the locking recess 454*a*. Thus, it is possible to increase the service life of the sealing member 471 and stably and effectively form the waterproof structure between the canister 410 and the canister seat 410*b*.

FIG. 30 illustrates a modification of the restraint included in the canister type thruster according to the fourth embodiment of the present invention, and particularly is a perspective view illustrating a restraint of a canister type thruster according to another embodiment. Referring to FIG. 30(*a*), a first locking member 464 may have an open lower surface, and an upper surface of a locking recess 464*a* may be provided as an inclined plane so as to be inclined downward with the approach to the inner surface of the trunk 2. The locking recess 464*a* may be formed to have a quadrilateral sectional shape. Since the upper surface and lateral surfaces of the locking recess 464*a* are provided perpendicular to each other, it is possible to more efficiently restrain the canister 410 in a horizontal direction when a locked rod 462 is fitted into the locking recess 464*a*.

Referring to FIG. 30(*b*), the locked rod 462 fitted into the locking recess 464*a* may be formed to have a quadrilateral sectional shape in correspondence to the shape of the locking recess 464*a* such that an upper surface thereof is inclined downward with the approach to the inner surface of the trunk 2. Thus, the degree of compression of the sealing member 471 at the lower portion of the canister 410 can be adjusted according to the length by which the locked rod 462 is fitted into the locking recess 464*a* of the first locking member 464. A lower surface of the locked rod 462 may be provided flat.

FIGS. 31 to 36 are views illustrating a method of installing the canister type thruster according to the embodiment of the present invention.

Unless otherwise indicated or described by separate numerals or symbols, components of the canister type thruster in the method of installing the canister type thruster according to the embodiment of the present invention are substantially the same as those of the canister type thruster 100 according to the first embodiment of the present invention, and so duplicate description thereof will be omitted.

FIG. 31 is a perspective view illustrating a guide module used in the method of installing the canister type thruster according to the embodiment of the present invention, and FIG. 32 is a front view of FIG. 31. Further, FIGS. 33 to 36 are views illustrating processes of installing the canister type thruster according to the embodiment of the present invention.

The guide module used in the method of installing the canister type thruster according to the embodiment of the present invention may include an upper guide unit 560 and lower guide unit 560 that are respectively installed at upper and lower sides of the inner surface of the trunk 2 of the hull 1. Each of the upper and lower guide units 560 supports the rack 141 to be able to guide the upward/downward movement of the canister 110.

Hereinafter, a state in which only the upper and lower guide units 560 are installed will be suggested as an example. However, a guide unit 560 additionally installed on a lift track of the rack 141 of the guide device may be further provided, and the number of guide units is not limited.

As illustrated in FIGS. 31 and 32, the lower guide unit 560 includes a support bracket 561 that is fixed to the inner surface of the trunk 2, two toothed-part guides 562 that are symmetrically provided at opposite sides of the support bracket 561 and are in contact with toothed parts 141*b* at opposite sides of the rack 141, and a lateral guide 563 that is provided for the support bracket 561 between the two toothed-part guides 562 so as to come into contact with a lateral surface (a flat surface free of the toothed part) of the rack 141 to guide the upward/downward movement of the rack 141. The lower guide unit 560 maintains a C shape in which the two toothed-part guides 562 and the lateral guide 563 surround the rack 141, and thereby it can support the rack 141 without arbitrary movement.

The support bracket 561 constituting frames of the two toothed-part guides 562 and the lateral guide 563 may be manufactured by welding a plurality of metal plates. The support bracket 561 may be fixed to the inner surface of the trunk 2 by welding.

The two toothed-part guides 562 and the lateral guide 563 respectively include sliding pads 562*a* and 563*a* that come into contact with the rack 141 to guide upward/downward movement of the rack 141. Each of the sliding pads 562*a* and 563*a* may be mounted on inner surfaces of the toothed-part guides 562 and the lateral guide 563 so as to be able to be coupled or decoupled by bolting, and thereby can be replaced in the event of wear or damage. Further, at least one thickness adjusting plate 562*b* and at least one thickness adjusting plate 563*b* may be interposed between an entry guide 562*c* and the sliding pad 562*a* of the toothed-part guide 562 and between an entry guide 563*c* and the sliding pad 563*a* of the lateral guide 563 in order to adjust a gap between the sliding pad 562*a* and the rack 141 and a gap between the sliding pad 563*a* and the rack 141 when installed.

The entry guides 562*c* of the toothed-part guides 562 and the entry guide 563*c* of the lateral guide 563 maintain an inclination with respect to the lifting direction of the rack 141 such that the rack 141 can be smoothly guided to a space defined thereby, and upper and lower ends of the sliding pads 562*a* and 563*a* may also be formed with inclination guide faces 562*d* and 563*d* that maintain an inclination with respect to the lifting direction of the rack 141.

The sliding pads 562*a* and 563*a* may be formed of a non-metallic material having weaker rigidity than the rack 141 so as to be able to protect the toothed parts 141*b* of the rack 141 as well as guide smooth sliding movement of the toothed parts 141*b*, and preferably is a synthetic resin material having low frictional resistance, high wear resistance, and high impact resistance.

The upper guide unit 560 may be provided substantially in the same form as the lower guide unit 560. However, in consideration of the fact that the rack 141 is separated from and reenters the upper or lower guide unit 560 when the canister 110 moves up or down, the entry guides 562*c* and 563*c* guiding the entering of the rack 141 with an inclination may be disposed in opposite directions.

A spaced distance between the upper guide unit 560 and the lower guide unit 560 may be provided shorter than the full length of the rack 141. This is intended to realize the stable upward/downward movement of the rack 141 by causing the rack 141 to be liftably supported by the upper guide unit 560 and the pinions 142 of the lift drive 143 or by the lower guide unit 560 and the pinions 142 of the lift drive 143, i.e. by maintaining at least two point supports.

When this canister type thruster 100 is first installed in the hull 1 or is decoupled from the hull 1 to fix a problem and then is again coupled to the hull 1, the canister 110 equipped with the propellant head 130 is hoisted by a crane, and then is lowered to enter an upper opening of the trunk 2.

At this time, the racks 141 of the opposite sides of the canister 110 are guided for entry by the upper guide unit 560, and then are engaged with the pinions 142 of the lift drives 143 located below the racks so as to be stably supported. Afterwards, the canister 110 can be guided by operations of the lift drives 143, and the descending racks 141 can be naturally guided into the lower guide unit 560 so as to be stably supported.

Particularly, the present embodiment, since the upper guide unit 560 and the lower guide unit 560 are disposed on the same line as the rack 141 and guide the rack 141, the canister type thruster of the present invention can be easily installed compared to typical canister type thrusters in which the guide units and the lift units are disposed at different positions.

If the guide units and the lift units are separately provided as in the typical canister type thrusters, accurate engagement of the rack and the pinion of the lift unit should also be considered while maintaining accurate coupling of the guide unit in the installing process, and thus it is very difficult to realize accurate installation while maintaining a coupling tolerance of each component. This is because the giant structure such as the canister is not easily handled due to its size and weight. The canister type thruster of the present embodiment can realize easier installation because the upper guide unit 560 and the lower guide unit 560 are disposed on the same line as the rack 141 and guide the rack 141. In addition, since the canister type thruster of the present embodiment can simplify, for instance, a configuration in which a separate rail for guidance need not be installed on the canister 110, it is possible to obtain effects of reducing manufacture cost and increasing productivity.

Meanwhile, the aforementioned canister 110 should be accurately assembled with the guide module. To this end, the guide module should be accurately installed at a preset position of the inner surface of the trunk 2. At this time, when the guide module is fixed at a preset position of the inner surface of the trunk 2 by welding, there may cause an error between the preset position (designed installation position) and an actually installed position due to welding deformation. For example, the support bracket 561 constituting the frames of the two toothed-part guides 562 and the lateral guide 563 can be fixed to the inner surface of the trunk 2 by welding. At this time, due to welding deformation, an error may occur between the preset position and the actually installed position.

Further, when the welded guide module is separated and installed again for error correction, the resultant work expenses are required. Even if the guide module is installed again, deformation may occur again due to the welding, and thus the efficiency of installation is considerably reduced.

Hereinafter, processes S401 to S431 of effectively installing the guide module based on the forgoing while addressing the aforementioned problems will be described with reference to FIGS. 33 to 36.

As described above, the guide module may include the upper and lower guide units 560 installed at the upper and lower sides of the lift drive 143. Further, at least one guide unit may be further installed between the upper guide unit 560 and the lower guide unit 560 as needed in addition to the upper guide unit 560 and the lower guide unit 560. For the convenience of description, an example in which the upper guide unit 560 and the lower guide unit 560 are installed in the trunk will be described, but the description will be mainly made based on the lower guide unit 560.

Referring FIGS. 33 and 34, the guide units guiding the upward/downward movement of the canister 110 equipped with the racks 141 are installed at preset positions of the inner surfaces of the trunk blocks B of the hull or the floating structure which are manufactured in a plurality of block units, and the trunk blocks B1 to B3 are assembled (S401 and S411). Here, the guide units are disposed on the same line as each of the racks 141, and may be installed in an equal form at opposite sides of the trunk at which the lift units 140 are located. Further, two or more guide units may be installed on the inner surface of the trunk such that a spaced distance between the uppermost guide unit (upper guide unit 560) installed in the first block B1 and the lowermost guide unit (lower guide unit 560) installed in the third block B3 is shorter than the full length of the rack 141. In another example, the guide unit may be installed on the second block B2.

Each of the guide units includes a support bracket 561, toothed-part guides 562, and a lateral guide 563. The toothed-part and lateral guides 562 and 563 may include entry guides 562*c* and 563*c*, thickness adjusting plates 562*b* and 563*b*, and sliding pads 562*a* and 563*a*, respectively.

As illustrated in FIG. 33, the support bracket 561 of the lower guide unit 560 is fixed to the inner surface of the trunk third block B3 by welding, and the entry guides 562*c* and 563*c* previously manufactured according to design dimensions are installed at a front portion and opposite sides of the support bracket 561. The entry guides 562*c* and 563*c* may be mounted by a welding method, a bolting method, or the like. The support bracket and the entry guides 562*c* of the upper guide unit 560 (see FIG. 34) provided substantially in the same form as the lower guide unit 560 are also installed on the inner surface of the trunk block B1 like the lower guide unit 560. The lower guide unit 560 and the upper guide unit 560 may be installed in different order or at the same time.

As illustrated in FIG. 34, the guide units are mounted, and then the trunk blocks B1 to B3 are sequentially assembled (coupled) by welding and fasters (bolts). Therefore, the upper guide unit 560 is located in the upper first block B1, and the lower guide unit 560 is located in the lower third block B3.

Next, referring to FIG. 35, positions at which the guide units are installed are measured (S421). At this time, light can be applied to the position of each of the guide units, and information on the position of each of the guide units can be extracted based on at least one of the time, distance, and angle of reflected light. To this end, position meters 570 may be used, and a laser beam, an infrared beam, etc. may be used. The position meters 570 may be installed in the aforementioned installation spaces 3 or maintenance spaces 6. The position meters 570 may be installed in meter installation spaces S that are separately provided at the opposite sides of the inner surface of the trunk 2. The position meters 570 may apply light to positions (measurement points) at which the support bracket 561 and the entry guides 562*c* and 563*c* of the guide unit are installed, and extract information (e.g. X, Y, and Z coordinate values) on the position of the guide unit based on at least one of the time, distance, and angle of reflected light. The position information of the guide unit measured in this way is transmitted to a monitoring system connected to a network to enable a worker to check the position at which the guide unit is installed.

Figure 36:
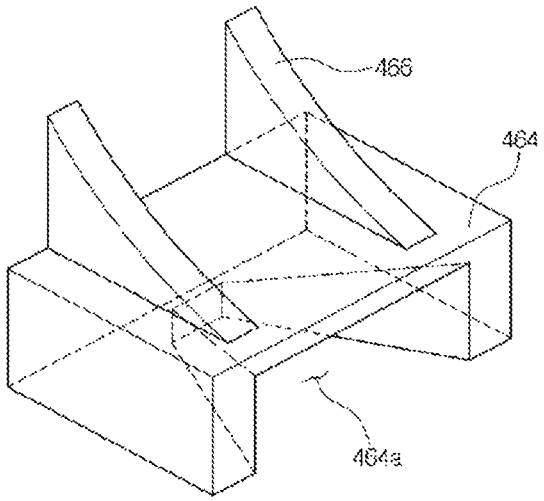
Figure 36:
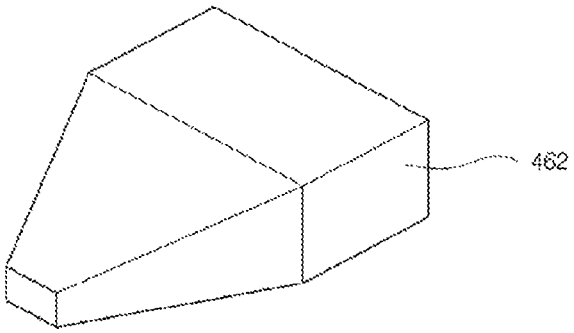

Next, referring to FIG. 36, a thickness of the guide unit is adjusted to correct the installed position of the guide unit based on an error value between the measured installed position of the guide unit and the preset position (S431). FIG. 36 is a top view illustrating the guide unit, a more detailed form of which is referred along with FIGS. 31 and 32. Here, to correct the installed position of the guide unit, the thickness adjusting plates 562*b* and 563*b* are designed to have their thicknesses based on the aforementioned error value in a state in which the support bracket 561 and the entry guides 562*c* and 563*c* of the guide unit are installed, and the thickness adjusting plates 562*b* and 563*b* are manufactured. Here, the term "manufactured" can include a meaning of processing the thickness adjusting plates 562*b* and 563*b* to as much as a necessary thickness in order to correct the installed position of the guide unit. The thickness adjusting plates 562*b* and 563*b* are installed in the front of the entry guides 562*c* and 563*c*, and the sliding pads 562*a* and 563*a* previously manufactured according to design dimensions are installed in the front of the thickness adjusting plates 562*b* and 563*b*.

For example, in a state in which the support bracket 561 and the entry guides 562*c* and 563*c* of the guide unit are installed, the installed position of the guide unit is measured. As a result, when the guide unit is displaced from the preset position (design position) to the left by a distance of "2 mm," the error value between the preset position and the actually installed position has a difference of "2 mm." Here, it is assumed that the left and right thickness adjusting plates 562*b*-1 and 562*b*-2 installed on the entry guides 562*c* that are disposed at the opposite sides of the support bracket 561 first are each designed to have a thickness of "5 mm," and the sliding pads 562*a* and 563*a* are each designed to have a thickness of "30 mm."

To correct the installed position of the guide unit based on the aforementioned error value, the left thickness adjusting plate 562*b*-1 is designed to change its thickness to "7 mm,", and the right thickness adjusting plate 562*b*-2 is designed to change its thickness to "3 mm." The left and right thickness adjusting plates 562*b*-1 and 562*b*-2 are manufactured according to the changed thicknesses. Afterwards, as illustrated in FIG. 36, the manufactured left and right thickness adjusting plates 562*b*-1 and 562*b*-2 are installed in the front of the entry guides 562*c*, and the sliding pads 562*a* are installed in the front of the left and right thickness adjusting plates 562*b*-1 and 562*b*-2. In the case of the thickness adjusting plate 563*b* installed on the entry guide 563*c* disposed at the front portion of the support bracket 561, a change in thickness is not required, and thus the thickness adjusting plate 563*b* is manufactured according to original design dimensions and is installed at the corresponding position. Thereby, the installed position of the guide unit can be corrected by adjusting the thicknesses of the left and right thickness adjusting plates 562*b*-1 and 562*b*-2.

As another example, the toothed-part guides 562 and the lateral guide 563 may be made up of only the entry guides 562*c* and 563*c* and the sliding pads 562*a* and 563*a* without the thickness adjusting plates 562*b* and 563*b*. In this case, the entry guides 562*c* and 563*c* are previously manufactured according to the design dimensions and are installed on the support bracket 561, and in this state, the sliding pads 562*a* and 563*a* are designed and manufactured to suitable thicknesses based on the aforementioned error value. As described above, for example, when each of the guide units is displaced to the left by a distance of "2 mm," an error value between the preset position and the actually installed position has a difference of "2 mm." When the sliding pads 562*a* and 563*a* are each designed to have a thickness of "35 mm," the left sliding pads 562*a*-1 is designed to change its thickness to "37 mm," and the right thickness adjusting plates 562*a*-2 is designed to change its thickness to "33 mm." The left and right sliding pads 562*a*-1 and 562*a*-2 are manufactured according to the changed thicknesses and are installed in the front of the entry guides 562*c*. In this way, the installed position of the guide unit can be corrected by adjusting the thicknesses of the left and right sliding pads 562*a*-1 and 562*a*-2. Since the sliding pad 563*a* installed on the entry guide 563*c* disposed at the front portion of the support bracket 561 need not be changed in thickness, the sliding pad 563*a* is manufactured according to original design dimensions and is installed at the corresponding position. The method of correcting the installed position of the guide unit can be equally applied to the upper guide unit 560.

In processes S401 to S431 of FIGS. 33 to 36 above, before or after the guide unit is installed, the pinions 142 engaged with the rack 141 and the lift drive 143 equipped with the drive source driving the pinions 142 may be fixed to the stationary structure 4 in the installation space 3 formed in the inner surface of the trunk 2. Like the guide unit, the lift drive 143 may also be subjected to measurement of an installed position to be able to correct the installed position based on an error value by comparing a preset position and an actually installed position. As another example, an installed position of the stationary structure 4 on which the lift drive 143 is installed is measured to cause the stationary structure 4 to be accurately located at a designed position. Thereby, only by installing the lift drive 143 on the corresponding stationary structure 4, the lift drive 143 can be accurately installed.

In the aforementioned embodiment, the example in which, to correct the installed position of the guide unit, the thickness adjusting plates 562*b* and 563*b* are designed to change their thickness based on the error value in the state in which the support bracket 561 and the entry guides 562*c* and 563*c* of the guide unit are installed, and are manufacture and installed has been described, but the present invention is not limited thereto. That is, in a state in which the thickness adjusting plates 562*b* and 563*b* are previously manufactured according to design dimensions, the thickness adjusting plates 562*b* and 563*b* may be processed to necessary thickness to correct the installed position of the guide unit, and then may be installed.

Further, in a state in which the thickness adjusting plates 562*b* and 563*b* and the sliding pads 562*a* and 563*a* are all installed, only the thickness adjusting plates 562*b* and 563*b* whose thicknesses need to be adjusted to correct the installed position of the guide unit may be decoupled, processed and installed again. This can be equally applied to the guide unit including the entry guides 562*c* and 563*c* and the sliding pads 562*a* and 563*a* without the thickness adjusting plates 562*b* and 563*b*. Since the sliding pads 562*a* and 563*a* and the thickness adjusting plates 562*b* and 563*b* are mounted by the bolting method, even if they are decoupled, processed and installed again, this does not influence a change in the position of the guide unit.

Further, when the thickness adjusting plates 562*b* and 563*b* are previously manufactured to have various thicknesses, two or more of the thickness adjusting plates 562*b* and 563*b* may be combined based on the aforementioned error value and be installed in the front of the entry guides 562*c* and 563*c*. Here, when two or more of the thickness adjusting plates 562*b* and 563*b* are installed on the entry guides 562*c* and 563*c* along with the sliding pads 562*a* and 563*a*, the installed position of the guide unit may be corrected by adjusting the thicknesses in such a manner that other thickness adjusting plates are further added to the installed thickness adjusting plates 562*b* and 563*b* or some of the installed thickness adjusting plates 562*b* and 563*b* are removed. In this case, work such as separate processing or design change is not required, and the installed position of the guide unit can be more rapidly and efficiently corrected.

Processes S401 to S431 of FIGS. 33 to 36 may be performed in a pre-erection (PE) area. A block B going through all necessary processes may be installed at the position to be installed in the hull or the floating structure or be coupled with other blocks.

Although exemplary embodiments of the present invention have been described for illustrative purposes, those skilled in the art will appreciate that various modifications, additions and substitutions are possible, without departing from the scope and spirit of the invention as disclosed in the accompanying claims. The scope of the present invention should be limited only by the accompanying claims.

The invention claimed is:

1. A canister type thruster mounted in a trunk of a ship, comprising at least one guide module configured to guide upward/downward movement of a canister, wherein the guide module includes:

a guide unit that is installed on an inner surface of the trunk to support a rack installed on an outer surface of the canister in parallel with a lifting direction and to guide upward/downward movement of the canister;

sliding pads that relieve an impact or a friction applied to the guide unit; and support steps that are provided between the guide unit and the sliding pad to support the sliding pads, wherein the guide unit includes:

a guide bracket that is fixed to the inner surface of the trunk;

toothed-part guides that are provided for the guide bracket and come into contact with toothed parts of the rack to guide upward/downward movement of the rack; and a lateral guide that is provided for the guide bracket and comes into contact with a lateral portion of the rack to guide the upward/downward movement of the rack, and wherein the support step is inserted into a support groove formed in a front surface of each of the toothed-part guides or the lateral guide and a rear surface of the sliding pad to a predetermined depth so as to support the sliding pad.

2. The canister type thruster according to claim 1, wherein:

the rack has the toothed parts symmetrically formed at opposite sides thereof in a width direction thereof; and the toothed-part guides are symmetrically formed at opposite sides of the support bracket so as to guide the toothed parts of the rack.

3. The canister type thruster according to claim 1, wherein the sliding pads are provided at portions at which the toothed-part guides and the lateral guide come into contact with the rack to guide the upward/downward movement of the rack so as to be able to be decoupled and coupled.

4. The canister type thruster according to claim 3, wherein the support steps are provided in the front of each of the toothed-part guides or the lateral guide so as to protrude from each of the toothed-part guides or the lateral guide to support the sliding pad.

5. The canister type thruster according to claim 4, wherein the support step is provided at a front lower end of each of the toothed-part guides or the lateral guide such that a lower end of the sliding pad is caught thereon.

6. The canister type thruster according to claim 4, wherein the support step is formed to be integrated with each of the toothed-part guides or the lateral guide or to be able to be decoupled from or coupled to each of the toothed-part guides or the lateral guide.

7. The canister type thruster according to claim 2, wherein the sliding pads are provided at portions at which the toothed-part guides and the lateral guide come into contact with the rack to guide the upward/downward movement of the rack so as to be able to be decoupled and coupled.

* * * * *